US006875047B2

(12) United States Patent
Ueda

(10) Patent No.: US 6,875,047 B2
(45) Date of Patent: Apr. 5, 2005

(54) CONNECTOR

(75) Inventor: Hirohisa Ueda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/726,706

(22) Filed: Dec. 4, 2003

(65) Prior Publication Data

US 2004/0110412 A1 Jun. 10, 2004

(30) Foreign Application Priority Data

Dec. 6, 2002 (JP) ..... 2002-354782
Jul. 15, 2003 (JP) ..... 2003-196954

(51) Int. Cl.[7] ..... H01R 12/24
(52) U.S. Cl. ..... 439/495; 439/260
(58) Field of Search ..... 439/260, 492–497

(56) References Cited

U.S. PATENT DOCUMENTS 5,695,360 A * 12/1997 Seto et al. ..... 439/495
5,934,932 A * 8/1999 Ito ..... 439/495
6,116,947 A * 9/2000 Takayasu ..... 439/495

FOREIGN PATENT DOCUMENTS

JP 9-63718 3/1997

* cited by examiner

*Primary Examiner*—Truc Nguyen
(74) *Attorney, Agent, or Firm*—Armstrong, Kratz, Quintos, Hanson & Brooks, LLP

(57) ABSTRACT

A holder 2 which holds a FPC 4 is coupled with a connector 1. The connector 1 includes a female housing 3 and a terminal metal fitting 14. The female housing 3 houses the terminal metal fitting 14. The terminal metal fitting 14 includes a pair of contact pieces 20*a* and 20*b*. The holder 2 is inserted in between the pair of contact pieces 20*a* and 20*b*. It is assumed that a temperature change is ΔT, the linear expansion coefficient of the holder 2 is βa, and the distance between a first fixing portion C and a contact S is 1*a*. It is also assumed that the linear expansion coefficient of the terminal metal fitting 14 is βb, and the distance between a second fixing portion and the contact S is 1*b*. Assuming that the elastic coefficient of the contact piece 20*b* is k, the static friction coefficient between the conductor 5 of FPC 4 and terminal metal fitting 14 is $\mu$, and the elastic restoring force of the contact piece 20*b* is F, $$\Delta T \times \beta a \times 1a - \Delta T \times \beta b \times 1b \leqq 2 \times (\mu \times F/k)$$

In this way, even when the terminal metal fitting is downsized and formed with multi-poles and low insertion force of the connector is realized, the connector can be surely electrically connected to a complementary conductor.

5 Claims, 12 Drawing Sheets

CONNECTOR

BACKGROUND OF THE INVENTION

1. Field of the Invention

This invention relates to a connector used for connection of electric wires.

2. Description of the Related Art

A motor vehicle which is a moving body includes a great variety of electronic devices. The motor vehicle have wire harnesses arranged to transfer an electric power and control signal to the electronic devices. The wire harness includes a plurality of electric wires and a plurality of connectors. The electric wire is a coated wire consisting of a conductive core and an insulating coating which coats the core.

The connector includes a conductive terminal metal fitting and an insulating connector housing. The terminal metal fitting is attached to the end of the electric wire so that it is electrically connected to the core. The connector housing houses the terminal fitting. The connector housed in the connector housing is connected to the connector of the electric device to transfer a control signal to the electronic device.

The terminal metal fitting has been proposed which is provided with a pair of contact pieces sandwiching a conductor such as a flat circuit body inclusive of an FPC (Flexible Printed Circuit), FFC (Flexible Flat Cable), etc. (see JP-A-9-63718). In such terminal fittings, with a complementary conductor (terminal fitting) being located on the surface of the one contact piece, the other contact piece is adapted to urge the conductor in the complementary connector toward the one contact piece.

In the connector, i.e. terminal fittings conventionally employed, the urging force of the other contact piece was kept above a predetermined value. Further, in the terminal metal fittings, the rigidity of the pair of contact pieces were increased so that they are difficult to be elastically deformed, thereby sandwiching the complementary conductor between the pair of contact pieces. The terminal metal fitting intends to prevent the complementary conductor sandwiched between the contact pieces from being shifted, thereby preventing fretting corrosion from occurring at these contact points. In this way, the conventional terminal metal fitting was electrically connected to the complementary conductor.

Meanwhile, the conventional terminal metal fittings were electrically connected to the complementary conductor in such a way that the rigidity of the contact pieces is increased and the urging force thereof is kept above a predetermined value.

On the other hand, the motor vehicle with the wire harness arranged therein includes a great variety of electronic devices. Therefore, there is a tendency that the number of electric wires is increased so that the wire harness has an increased weight and is upsized.

In order to suppress the increase in weight and upsizing, the connector accommodated a larger number of terminal metal fittings (realization of multi-poles of the terminal metal fitting) and downsized the terminal fitting. In order to facilitate the arrangement of the wire harness, it has been demanded that the force applied when the connector is coupled with a complementary connector is decreased (realization of low insertion force).

When the terminal metal fitting is down-sized, it becomes to difficult to assure the urging force over a predetermined value and also difficult to surely connect the terminal metal fittings at issue to the complementary conductor. This may generate the fretting corrosion at the contacts described above. The realization of the multi-poles of the terminal metal fitting and low insertion force of the connector requires the urging force for a single terminal metal fitting to be suppressed. This further makes it more difficult to assure the urging force over the predetermined value, and hence to connect the terminal metal fittings to the complementary conductor. This leads to an increase in the possibility of fretting corrosion at the contact points described above.

SUMMARY OF THE INVENTION

An object of this invention is to provide a connector in which terminal metal fitting can be downsized and formed with multiple-poles, and surely electrically connected to a complementary conductor with no fretting corrosion even when insertion force is reduced.

In order to attain the above object, in accordance with this invention, there is provided a connector comprising:

a terminal metal fitting including a supporting portion and an elastic contact portion located apart therefrom within a cavity, a complementary conductor being located on the surface of the supporting portion, the complementary conductor being sandwiched between the supporting portion and the elastic contact portion under an elastic restoring force urging the complementary conductor toward the supporting portion; and a connector housing which houses the terminal metal fitting and is coupled with a complementary insulator supporting the complementary conductor, wherein a gap is formed between the elastic contact portion and inner face of the cavity, and assuming that the gap is A, a temperature change acting on the complementary conductor and insulator and the elastic contact portion is ΔT, a linear expansion coefficient of a union consisting of the complementary conductor and complementary insulator is βa, a distance between a first fixing portion where the complementary conductor is fixed and a contact between the complementary conductor and the elastic contact portion is 1*a*, a linear expansion coefficient of a union consisting of the connector housing and the terminal metal fitting is βb, and a distance between a second fixing portion where the the terminal metal fitting is fixed and the contact is 1*b*, $$A \geqq \Delta T \times \beta a \times 1a - \Delta T \times \beta b \times 1b,$$

and assuming that the elastic coefficient of the elastic contact portion is k, the static friction between the complementary conductor and the elastic contact portion is $\mu$ and the elastic restoring force of the elastic contact portion is F, $$\Delta T \times \beta a \times 1a - \Delta T \times \beta b \times 1b \leqq 2 \times (\mu \times F/k).$$

In the above configuration, since $\Delta T \times \beta a \times \mathbf{1}a - \Delta T \times \beta b \times \mathbf{1}b \leqq 2 \times (\mu \times F/k)$ holds, when the acting temperature changes so that the contact between the elastic contact portion of the terminal metal fitting and the complementary conductor is about to shift, the elastic contact portion is elastically deformed according to the movement of the contact. Therefore, even when the acting temperature changes, the elastic contact portion of the terminal metal fitting and the complementary conductor are shifted relatively from each other at the contact so that the elastic contact portion of the terminal metal fitting and the complementary conductor are shifted relatively from each other at the contact. Specifically, where the connector is employed in the wire harness arranged in a motor vehicle, even when the ambient temperature changes, the elastic contact portion of the terminal metal fitting and the complementary conductor are kept in contact at the contact. Thus, fretting corrosion can be prevented at the contact between the elastic contact portion of the terminal metal fitting and the complementary conductor.

By suppressing the elastic coefficient, i.e. rigidity of the elastic contact portion so that $\Delta T\times\beta a\times 1a-\Delta T\times\beta b\times 1b\leqq 2\times(\mu\times F/k)$, the elastic restoring force of the elastic contact portion, i.e. the contact load between the elastic contact portion and the complementary conductor can be suppressed (reduced). Therefore, even the terminal metal fitting is downsized and formed with its multi-polarities and the insertion force of the connector is realized, the elastic contact portion of the terminal metal fitting and the complementary conductor are not shifted relatively from each other, thereby preventing the fretting corrosion. Thus, the terminal metal fitting of the connector can be surely electrically connected to the complementary conductor.

Further, with respect to the gap A between the terminal metal fitting and the inner face of the cavity, $A\geqq\Delta T\times\beta a\times 1a-\Delta T\times\beta b\times 1b$ holds. For this reason, the elastic deformation of the elastic contact portion of the terminal metal fitting is not obstructed by the inner face of the cavity. Thus, the elastic contact portion can be surely elastically deformed so that the elastic contact portion of the terminal metal fitting and the contact conductor are not shifted relatively from each other, thereby preventing the fretting corrosion from occurring at the contact between the elastic contact portion and the complementary conductor.

It is preferred in the above connector that the conductor is inserted between the supporting member and the contact portion in a one direction and sandwiched therebetween, and the gap A in a first direction orthogonal to both the one direction and the elastic restoring force and in a second direction orthogonal to the one direction and along the elastic restoring force is expressed by $$A\geqq=\Delta T\times\beta a\times 1a-\Delta T\times\beta b\times 1b,\text{ and}$$

the elastic coefficient k in the respective one direction, the first direction and the second direction is expressed by $$\Delta T\times\beta a\times 1a-\Delta T\times\beta b\times 1b\leqq 2\times(\mu\times F/k).$$

In this configuration, in the one direction of inserting the complementary conductor, first direction orthogonal to the one direction and second direction orthogonal to both the one direction and the first direction, $\Delta T\times\beta a\times 1a-\Delta T\times\beta b\times 1b\leqq 2\times(\mu\times F/k)$. For this reason, even when the acting temperature changes, the terminal metal fitting and the complementary conductor are not shifted relatively from each other so that the elastic contact portion is elastically deformed according the movement of the contact between the terminal metal fitting and the complementary conductor.

Further, the gap A in a first direction orthogonal to both the one direction and the elastic restoring force and in a second direction orthogonal to the one direction and along the elastic restoring force is expressed by $$A\geqq\Delta T\times\beta a\times 1a-\Delta T\times\beta b\times 1b$$

For this reason, the elastic deformation of the terminal metal fitting is not obstructed by the inner face of the cavity.

Therefore, even the terminal metal fitting is downsized and with its multi-poles to lower the insertion force of the connector, the elastic contact portion of the terminal metal fitting can be surely electrically connected to the complementary conductor with no fretting corrosion.

It is preferred in the connector that the complementary conductor, the complementary insulator and the electric wire connected to the complementary conductor constitute a complementary member, and assuming that the acceleration which acts on the complementary member along the second direction is a2 and the mass of the complementary member is m, the elastic restoring force F of the elastic contact portion is expressed by $$F>m\times a1.$$

In this configuration, even when the acceleration a1 in the second direction acts on the complementary member, the complementary member is not relatively shifted between the supporting portion and the elastic contact portion of the terminal metal fitting. Further, the complementary member can be continuously sandwiched between the supporting portion and elastic contact portion of the terminal metal fitting.

Thus, the terminal metal fitting and the complementary conductor are not shifted relatively from each other at the contact so that the contact is not displaced. Accordingly, where the connector is employed in the wire harness arranged in the motor vehicle, even when the acceleration a1 acts in the second direction, the terminal metal fitting and the complementary conductor are not shifted relatively from each other at the contact so that they are kept in contact with each other. The connector according to this invention can prevent the elastic contact portion of the terminal metal fitting and the complementary conductor from being move relatively from each other at the contact, thereby surely connecting the elastic contact portion of the terminal metal fitting to the complementary conductor with no fretting corrosion.

It is preferred in the connector that the complementary conductor, the complementary insulator and the electric wire connected to the complementary conductor constitute a complementary member, and assuming that the acceleration which acts on the complementary member along a direction orthogonal to the second direction is a2 and the mass of the complementary member is m, the elastic restoring force F of the elastic contact portion is expressed by $$F>m\times a2/\mu.$$

In this configuration, since $F>m\times a2/\mu$ holds, even when the acceleration a2 orthogonal to the second direction acts on the complementary member, the complementary conductor is not relatively shifted between the supporting portion and the elastic contact portion. Further, the complementary member can be continuously sandwiched between the supporting portion and elastic contact portion of the terminal metal fitting.

Thus, the terminal metal fitting and the complementary conductor are not shifted relatively from each other at the contact so that the contact is not displaced. Accordingly, where the connector is employed in the wire harness arranged in the motor vehicle, even when the acceleration a1 acts in the second direction, the terminal metal fitting and the complementary conductor are not shifted relatively from each other at the contact so that they are kept in contact with each other. The connector according to this invention can prevent the elastic contact portion of the terminal metal fitting and the complementary conductor from being move relatively from each other at the contact, thereby surely connecting the elastic contact portion of the terminal metal fitting to the complementary conductor with no fretting corrosion.

In the connector according to this invention, the rigidity of the terminal metal fitting is reduced so that the elastic contact portion can be easily deformed. Even when the contact between the elastic contact portion and the complementary conductor is tends to be displaced, the elastic contact portion is elastically deformed correspondingly so that the elastic contact portion and the complementary conductor are kept in contact with each other at the contact. Namely, the elastic contact portion and the complementary conductor are prevented from being relatively shifted from each other at the contact so that the contact is not displaced.

Further, in this invention, a gap is located between the elastic contact portion and the inner face of the cavity so that the elastic contact portion can be elastically deformed in the gap. Namely, the elastic contact portion is deformed so that the contact between the elastic contact portion and the complementary conductor can be prevented from being displaced, thereby preventing the fretting corrosion.

For example, even when there is a relative movement between the terminal metal fitting and the complementary conductor owing to a difference in their thermal expansion coefficient and acceleration acts on the complementary member including the complementary conductor, the elastic contact portion is elastically deformed correspondingly. In this way, by suppressing (reducing) the rigidity of the elastic contact portion, the elastic restoring force of the elastic contact portion, i.e. the contact load between the elastic contact portion and the complementary conductor can be suppressed (reduced). Further, even when the terminal metal fitting is down-sized and formed with multi-poles and low insertion force of the connector is realized, the connector can be surely electrically connected to a complementary conductor.

For example, a terminal metal fitting 14 shown in FIG. 9 is accommodated in a terminal chamber which is a cavity of a connector housing. The connector housing is attached to a printed wiring board. The terminal metal fitting 14 is electrically connected to a conductor of FPC supported at its end by a holder which fits in the connector housing.

The FPC, when arranged in a motor vehicle, is secured to a vehicle body panel by a known wiring clip. The FPC from the wiring clip to the end and the holder which holds the end of the FPC constitutes a complementary member 100 in FIG. 10.

In FIGS. 10, 13 and 14, the holder and FPC which constitute the complementary member 100 are illustrated as a rectangular solid. The conductive portion of the FPC supported by the holder constitutes a complementary conductor and the holder which is an insulator constitutes a complementary insulator. The FPC constitutes a complementary electric wire electrically connected to the conductor of the FPC.

The terminal metal fitting 14 is made of e.g. a metallic plate. The terminal fitting 14 integrally includes a first electric contact portion 18 and a second electric contact portion 19. The first electric contact portion 18 is formed in a shape of plate. The first electric contact portion 18 is fixed to a printed wiring plate. The first electric contact portion 18, when the terminal fitting 14 is accommodated in the terminal chamber, is electrically connected to the conductor pattern on the printed wiring board. The first electric contact portion 18, i.e. portion (hereinafter referred to as a second fixing portion) where the terminal metal fitting 14 is fixed to the printed wiring board is indicated by symbol D.

The second electric contact portion 19 is electrically connected to the conductor of the FPC of the complementary member 100. The second electric contact portion 19 is composed of a pair of contact pieces 20. The pair of contact pieces 20 each of which are formed in a shape of rod are arranged in parallel apart from each other. The one end of each of the pair of contact pieces 20 is communicated with the first electric contact portion 18. The holder in the complementary member 100 and conductor of FPC supported by the holder are inserted in between the pair of contact pieces 20.

On the surface of the one contact piece 20 (hereinafter referred to as 20*a*), the conductor of the FPC supported by the holder 100 in the complementary member 100 is located, which is sandwiched between the one contact piece 20*a* and the other contact piece 20 (hereinafter referred to as 20*b*) The other contact piece 20*b* is equipped with a contact projection 21 which is convex toward the one contact piece 20*a*. In claims, the one contact piece 20*a* is defined as a supporting portion, whereas the other contact piece 20*b* is defined as an elastic contact portion.

When the holder of the complementary member 100 and the conductor of the FPC supported by the holder are inserted between the one contact piece 20*a* and the other contact piece 20*b*, the contact projection 21 comes in contact with the conductor of the FPC supported by the holder, and the other contact piece 20*b* urges the conductor of the FPC supported by the holder toward the one contact piece 20*a* in a direction of arrow Z in FIG. 9.

Specifically, in a state where the elastic restoring force F has been generated which urges the conductor of the FPC toward the one contact piece 20*a*, the FPC is sandwiched between the one contact piece 20*a* and the other contact piece 20*b*. The contact projection 21 comes in contact with the conductor of the FPC so that a contact S between the other contact piece 20*b* and the conductor of FPC, i.e. between the terminal metal fitting S and the complementary member 100 is generated at the tip of the contact projection 21.

The conductor of the FPC supported by the holder is inserted in between the pair of contact pieces 20*a* and 20*b* in a direction of arrow X in FIG. 9. The direction of arrow X agree with the longitudinal direction of the contact pieces 20*a* and 20*b* which is the one direction in claims. The direction of the elastic restoring force F of the other contact piece 20*b* is orthogonal to the direction of arrow X.

The holder is fixedly fit in the connector housing which houses the terminal metal fitting 14. The holder, i.e. portion (hereinafter referred to as a first fixing portion) where the complementary member is fixed to the connector housing is indicated by symbol C. Incidentally, at the first fixing portion C, the conductor of the FPC is fixed to the connector housing through the holder. In FIG. 10, the first fixing portion C is arranged at the extreme end of the complementary member 100 which is a rectangular solid.

The total linear expansion coefficient of the terminal metal fitting 14 and the connector housing is different from that of the holder and FPC in the complementary member 100. When the temperature which acts on the terminal metal fitting 14 and connector housing, and on the holder and EPC of the complementary member 100 changes, the degrees of expansion are different in both.

The terminal metal fitting 14, and holder and conductor of FPC are schematically illustrated in FIG. 11. FIG. 11A shows the state before the temperature changes and FIG. 11B shows the state after the temperature has changed. In FIGS. 11A and 11B, symbol A refers to the union of the holder and conductor of the complementary member 100 and symbol B refers to the union of the terminal metal fitting 14 and connector housing.

The displacement in the direction of arrow X between the respective contact points S1 and S2 of the holder and conductor of FPC and the metal fitting 14 is represented by W, and the temperature change is represented by ΔT. The linear expansion coefficient of the union of the holder and conductor of FPC of the complementary member 100 in the direction of arrow X is represented by βa. The distance between the fixing portion C and the above contact S of the union of the holder and conductor of FPC of the complementary member 100 in the direction of arrow X is represented by 1*a* (represented by 1*ax* in FIG. 10).

The linear expansion coefficient of the union of the terminal metal fitting 14 and connector housing is represented by βb. The distance between the second fixing portion D and the above contact S in the direction of arrow X is represented by 1*b* (represented by 1*bx* in FIG. 10). In this case, the following Equation (1) holds.

$$W=\Delta T\times\beta a\times 1a-\Delta T\times\beta b\times 1b \quad (1)$$

The state where the conductor of the FPC held in the holder of the complementary member 100 has been inserted between the pair of contact pieces 20*a* and 20*b* as shown in FIG. 10 can be illustrated as a model as shown in FIG. 12. In FIG. 12, symbol A denotes the holder of the complementary member 100 and the conductor of the FPC. Symbol B denotes the terminal metal fitting 14 and connector housing. Symbol C denotes a spring which is equivalent to the other contact piece 20*b* which can be elastically deformed. The spring coefficient k of the spring C is equal to the elastic coefficient k of the other contact piece 20*b* in the direction of arrow X. The spring C is elastically deformed which makes displaceable the contact S between the complementary member 100, i.e. conductor of the FPC and the terminal metal fitting 14. In the state shown in FIG. 12, the spring C which serves as the other contact piece 20*b* urges the terminal metal fitting 14 with an elastic restoring force F.

When the conductor of FPC, i.e. complementary member 100 and the terminal metal fitting 14 are about to move relatively, in order that they are immobile relatively, the condition represented by the following Equation (2) must be satisfied. In Equation (2), $\mu$ represents the static friction coefficient between the terminal metal fitting 14 and the conductor of FPC and $\underline{a}$ represents the amplitude of the relative movement.

$$k\times a\leqq\mu\times F$$

$$a\leqq\mu\times F/K \quad (2)$$

The displacement W between the contacts S1 and S2 and the above amplitude $\underline{a}$ satisfies the relationship represented by Equation (3).

$$W=2\times\underline{a} \quad (3)$$

According to Equations (1) to (3), in order that the contact between the terminal metal fitting 14 and the conductor of FPC is not displaced (the terminal metal fitting 14 and conductor of FPC are not shifted relatively at the contact S) when the temperature which acts on the terminal metal fitting 14, FPC, etc. changes by ΔT, the following relationship represented by Equation (4) must be satisfied.

$$\Delta T\times\beta a\times 1a-\Delta T\times\beta b\times 1b\leqq 2\times(\mu\times F/k) \quad (4)$$

If the elastic coefficient k and elastic restoring force F of the other contact piece 20*b* and other components satisfy the above Equation (4), the terminal metal fitting 14 and conductor of FPC are not shifted relatively, but the other contact piece 20*b* is deformed with the movement of the contact S. If the above Equation holds, where the connector is employed in the wire harness arranged in a vehicle, even when the ambient temperature changes by ΔT, the other contact piece 20*b* and conductor of FPC are not shifted relatively from each other at the contact S, the other contact piece 20*b* and conductor of FPC can be kept in contact with each other at the contact S.

The elastic coefficient k is proportional to the elastic restoring force F. Therefore, by suppressing (reducing) the elastic coefficient k, i.e. rigidity of the terminal metal fitting 14, the elastic restoring force F, i.e. contact load between the terminal metal fitting 14 and conductor of FPC can be suppressed (reduced). At this time, the contact S, i.e. the contact piece 20*b* of the terminal metallic fitting 14 is displaced by the displacement W in Equation (1).

The above displacement W and amplitude $\underline{a}$ are those in the direction of arrow X. However, the displacement W and amplitude $\underline{a}$ in the direction of arrow Y (FIG. 9) which is orthogonal to both arrow X and elastic restoring force F satisfy the relationships in Equations (1) to (4). In this case, reference symbol 1*a* (symbol 1*ay* in FIG. 10) denotes the distance between the first fixing position C of the union of the holder of the complementary member 100 and the conductor of FPC in the direction of arrow Y, and the above contact S. Reference symbol 1*b* (symbol 1*by* in FIG. 10) denotes the distance between the second fixing position D in the direction of arrow Y and the second fixing contact S.

Further, the displacement W and amplitude $\underline{a}$ in the direction of arrow Z (FIG. 9) which is orthogonal to the arrow X and along the elastic restoring force F) also satisfy the relationships represented by Equations (1) to (4). In this case, reference symbol 1*a* (symbol 1*az* in FIG. 10) denotes the distance between the first fixing position C of the union of the holder of the complementary member 100 and the conductor of FPC in the direction of arrow Z, and the above contact S. Reference symbol 1*b* (symbol 1*bz* in FIG. 10) denotes the distance between the second fixing position D in the direction of arrow Z and the second fixing contact S.

The direction of arrow Y represents the first direction defined in claims and the direction of arrow Z represents the second direction defined in claims.

Further, as shown in FIG. 13, in the state where the holder of the complementary member 100 and the conductor of FPC supported by the holder are sandwiched between the pair of contact pieces 20*a* and 20*b*, the acceleration a1 along the elastic restoring force F may act on the holder of the complementary member 100 and the conductor of FPC supported by the holder. In this case, in order that the other contact piece 20*b* and the conductor of FPC are not shifted relatively but kept in contact with each other, assuming that the mass of the union of the holder and FPC is $\underline{m}$, the relationship represented by the following Equation (5) must be satisfied. Incidentally, the mass m is that of the union of the FPC (which extends from the wiring clip which clips the FPC to the end of the FPC) and the holder which holds the end of the FPC.

$$F>m\times a1 \quad (5)$$

Therefore, if the above Equation (5) holds, the complementary member 100 is not shifted relatively to the contact pieces 20*a* and 20*b* therebetween. In addition, if the above Equation (5) holds, the complementary member 100 remains sandwiched between the pair of contact pieces 20*a* and 20*b* of the terminal metal fitting 14. Therefore, if Equation (5) holds, the contact S between the terminal metal fitting 14 and conductor of FPC will not be displaced. Specifically, where the connector is employed in the wire harness arranged in a vehicle, even when the acceleration a2 in the direction of arrow Z acts, the other contact piece 20*b* and conductor of FPC are not displaced relatively at the contact S, but the other contact piece 20*b* and conductor of FPC can be kept in contact with each other at the contact S.

Further, as shown in FIG. 14, in the state where the holder of the complementary member 100 and the conductor of FPC supported by the holder are sandwiched between the pair of contact pieces 20*a* and 20*b*, the acceleration a2 orthogonal to the elastic restoring force F may act on the holder of the complementary member 100 and the conductor of FPC supported by the holder. In this case, in order that the other contact piece 20*b* and the conductor of FPC are not shifted relatively but kept in contact with each other, assuming that the mass of the union of the holder and FPC is m, the relationship represented by the following Equation (6) must be satisfied.

$$F>m\times a2/\mu \quad (6)$$

Therefore, if the above Equation (6) holds, the complementary member 100 is not shifted relatively to the contact pieces 20*a* and 20*b* between the contact pieces 20*a* and 20*b*. In addition, if the above Equation (6) holds, the complementary member 100 remains sandwiched between the pair of contact pieces 20*a* and 20*b* of the terminal metal fitting 14. Therefore, if Equation (6) holds, the contact S between the terminal metal fitting 14 and conductor of FPC will not be displaced. Specifically, where the connector is employed in the wire harness arranged in a vehicle, even when the acceleration a2 in the direction of arrow Z acts, the other contact piece 20*b* and conductor of FPC are not shifted relatively from each other at the contact S, the other contact piece 20*b* and conductor of FPC can be kept in contact with each other at the contact S.

The above distances 1*ax*, 1*ay* and 1*az* are the distances between the first fixing position C and the contact S in the directions of arrows X, Y and Z. These distances 1*ax*, 1*ay* and 1*az* can be changed by shifting the first fixing position C where the conductor of FPC of the complementary conductor is fixed to the connector housing. These distances 1*ax*, 1*ay* and 1*az* can be also changed by fixing the conductor of FPC of the complementary conductor to the member other than the connector housing. Namely, the distances 1*ax*, 1*ay* and 1*az* can be changed by changing the position or member where the complementary conductor is fixed. In short, in this invention, the distances 1*ax*, 1*ay* and 1*az* maybe the distances between the position where the complementary conductor is fixed to any member such as the connector housing, and the contact S between the elastic contact piece of the terminal metal fitting 14 and the complementary conductor.

The above distances 1*bx*, 1*by* and 1*bz* are the distances between the second fixing position C and the contact S in the directions of arrows X, Y and Z. These distances 1*bx*, 1*by* and 1*bz* can be changed by shifting the second fixing position D where the terminal metal fitting 14 is fixed to the printed circuit board. These distances 1*bx*, 1*by* and 1*bz* can be also changed by fixing the terminal metal fitting 14 to the other member than the printed circuit board, such as the connector housing. Namely, the distances 1*ax*, 1*ay* and 1*az* can be changed by changing the position or member where the terminal metal fitting is fixed. In short, in this invention, the distances 1*bx*, 1*by* and 1*bz* maybe the distances between the position where the terminal metal fitting is fixed to any member such as the connector housing or printed circuit board, and the contact S between the elastic contact piece of the terminal metal fitting and the complementary conductor.

The above and other objects and features of the invention will be more apparent from the following description taken in conjunction with the accompanying drawings.

DESCRIPTION OF THE PREFERRED EMBODIMENTS

Now referring to FIGS. 1 to 8, an explanation will be given of a connector according to an embodiment of this invention.

Figure 5:
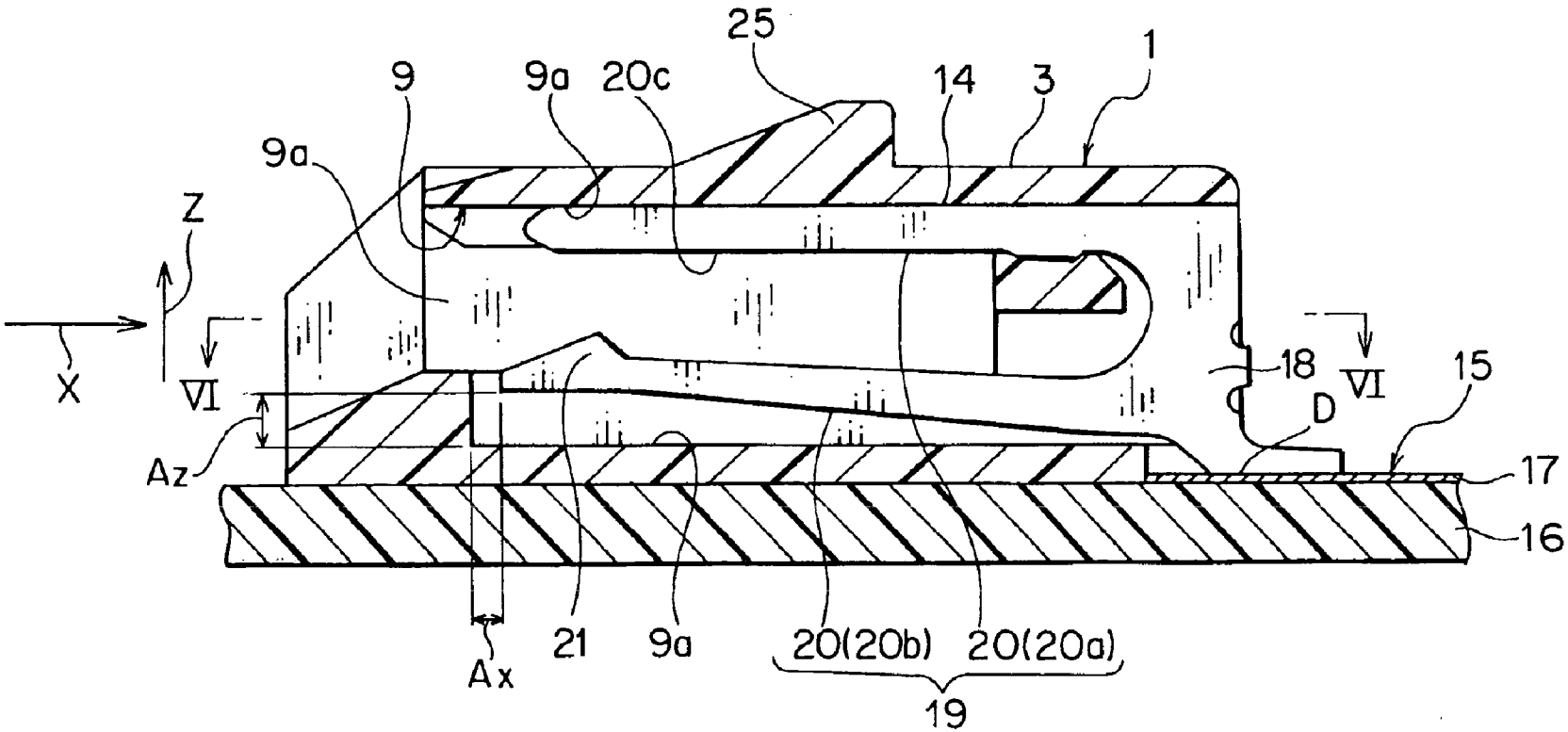
FIG. 5 is a sectional view taken in line V—V in FIG. 2.

A connector 1, as shown in FIG. 5, includes a female connector housing (hereinafter referred to as a female housing) which serves as a connector housing and a terminal metal fitting 14. With the terminal metal fitting 14 housed in the female housing 3, the connector 1, as shown in FIG. 1 is fit in a holder 2.

Figure 1:
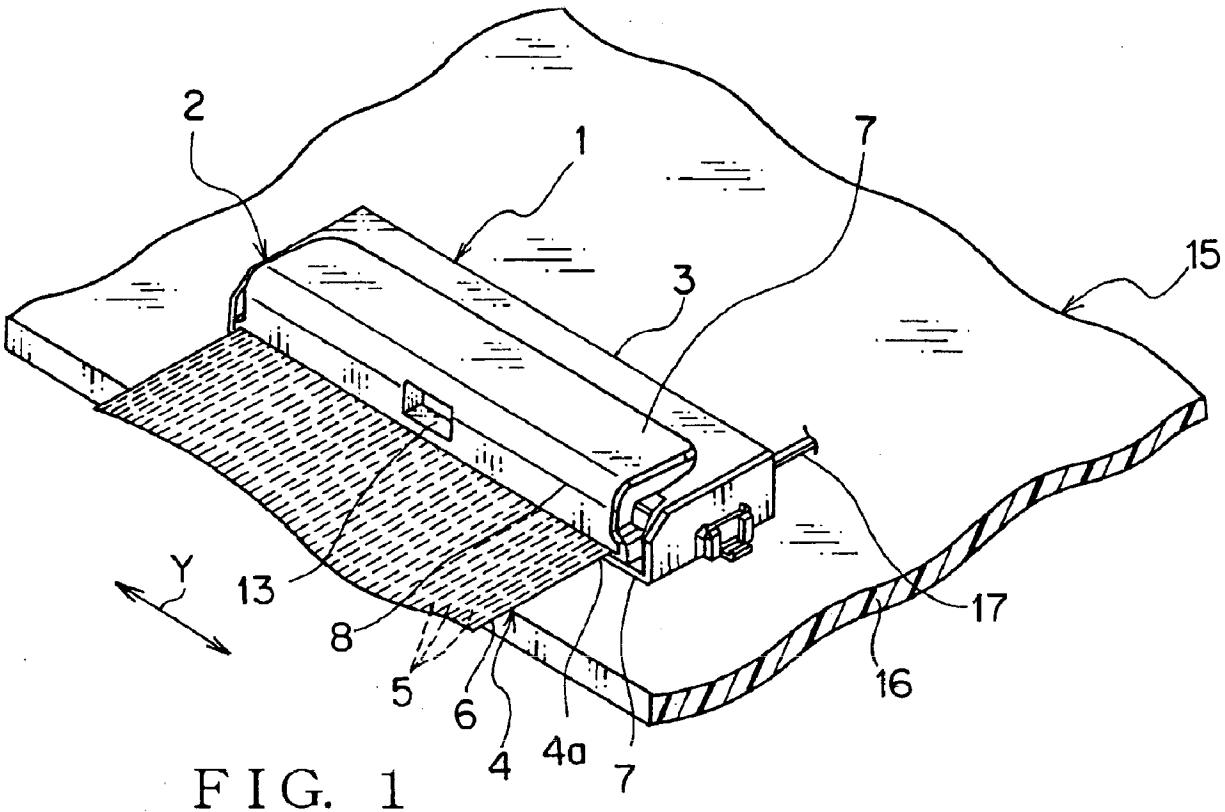
FIG. 1 is a perspective view of the state where a connector equipped with a terminal metal fitting according to an embodiment of this invention is fit in a holder.
Figure 2:
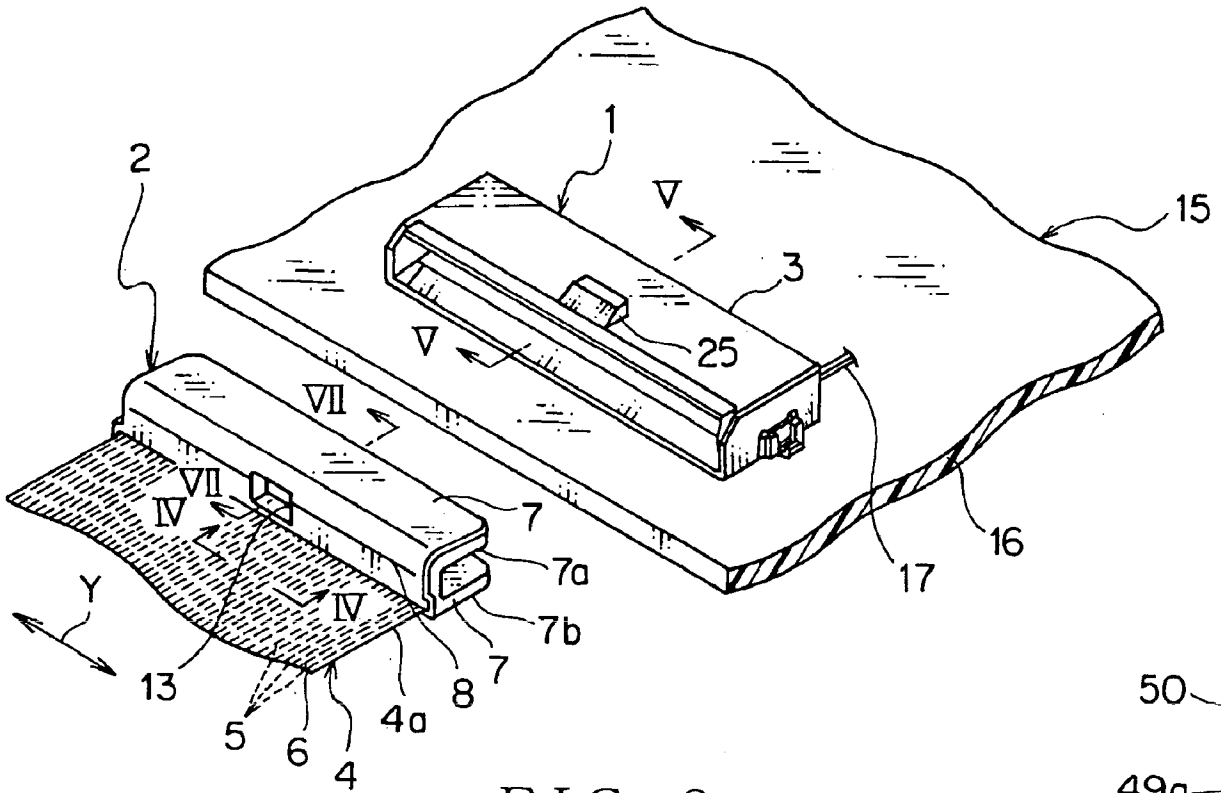
FIG. 2 is a perspective view of the state where the connector and holder shown in FIG. 1 are separated from each other.
Figure 3:
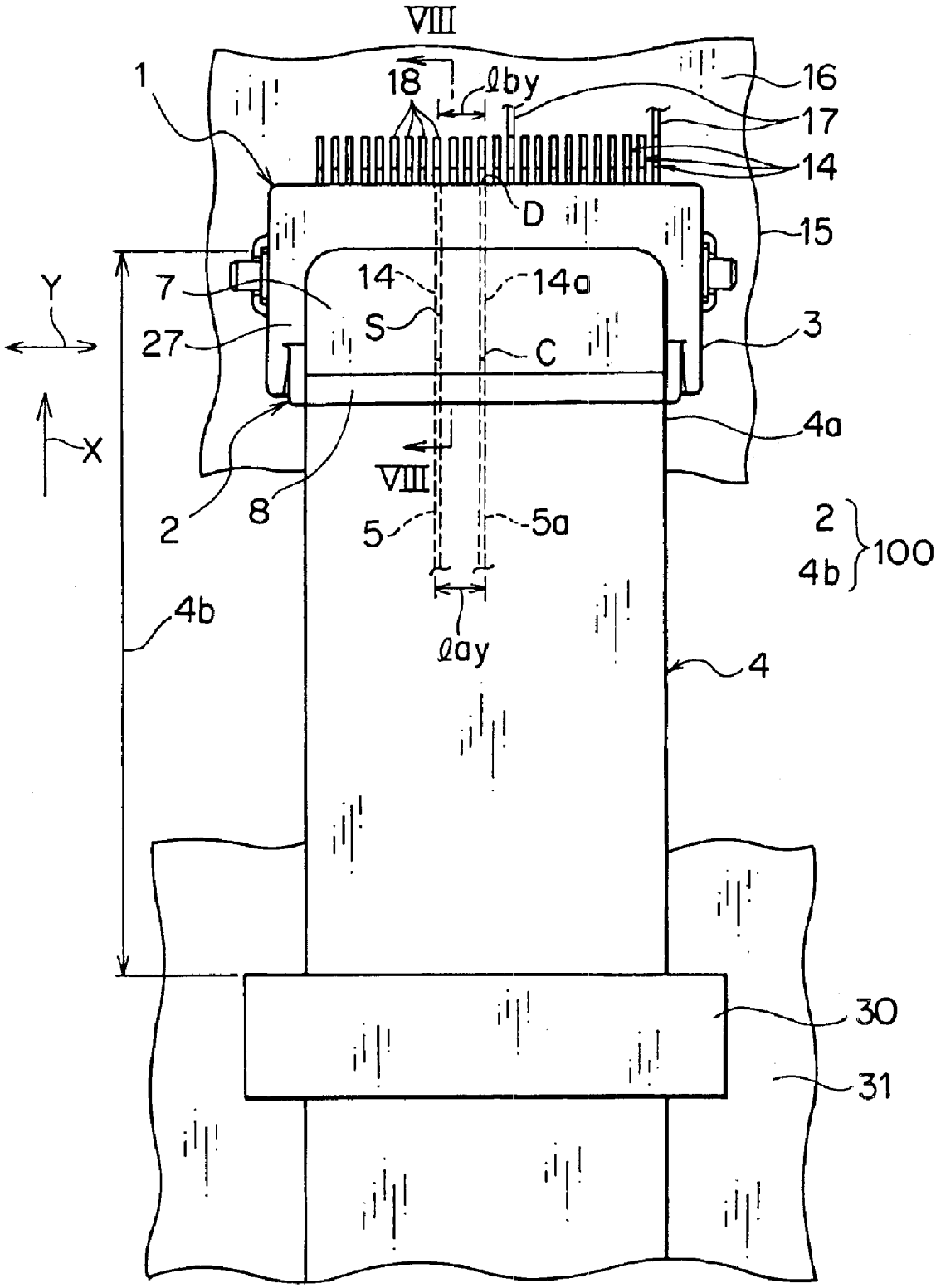
FIG. 3 is a plan view of the connector fit in the holder shown in FIG. 1.

The holder 2, as shown in FIGS. 1 to 3, serves to support the end of the FPC (Flexible Printed Circuit) 4 which serve electric wires.

Figure 4:
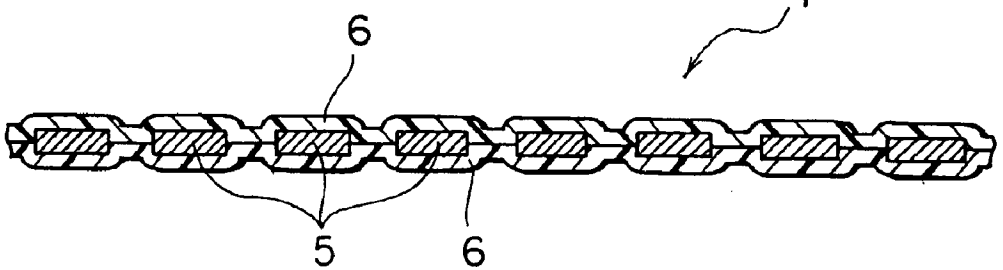
FIG. 4 is a sectional view taken in line IV—IV in FIG. 2.

The FPC 4 is formed as a flat circuit body. The flat circuit body is formed in a shape of a flat belt composed of a plurality of conductors and insulating coatings which coat the conductors. Specifically, as shown in FIG. 4, a plural of conductors 5 and a pair of insulating sheets 6 which coat the conductors 5. The conductors 5 are square in shape, and extend in one direction. The plurality of conductors 5 are in parallel to each other and arranged in a direction of arrow Y.

Figure 7:
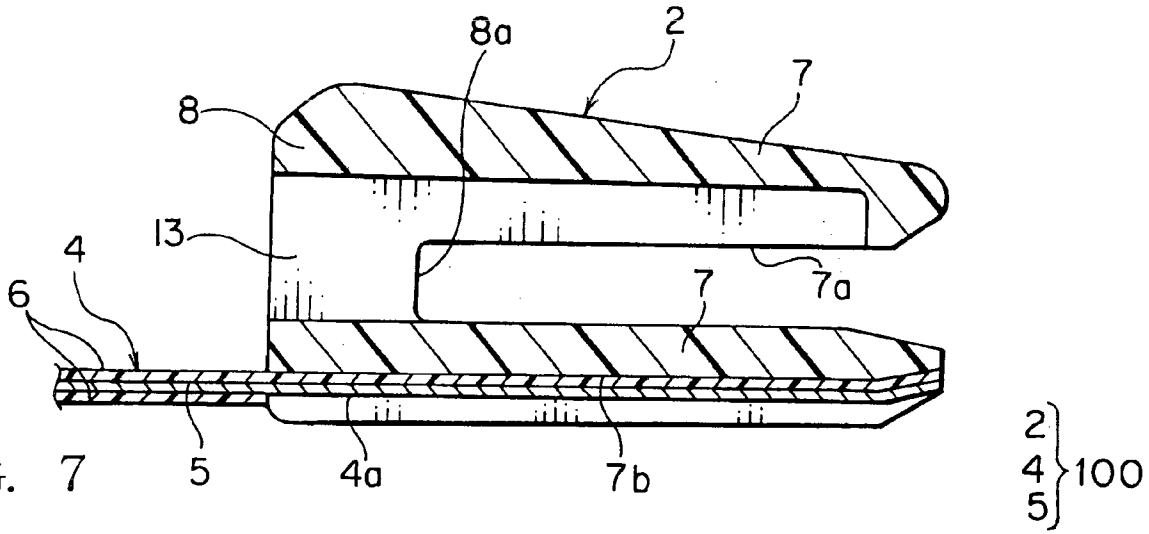
FIG. 7 is a sectional view taken in line VII—VII in FIG. 2.
Figure 8:
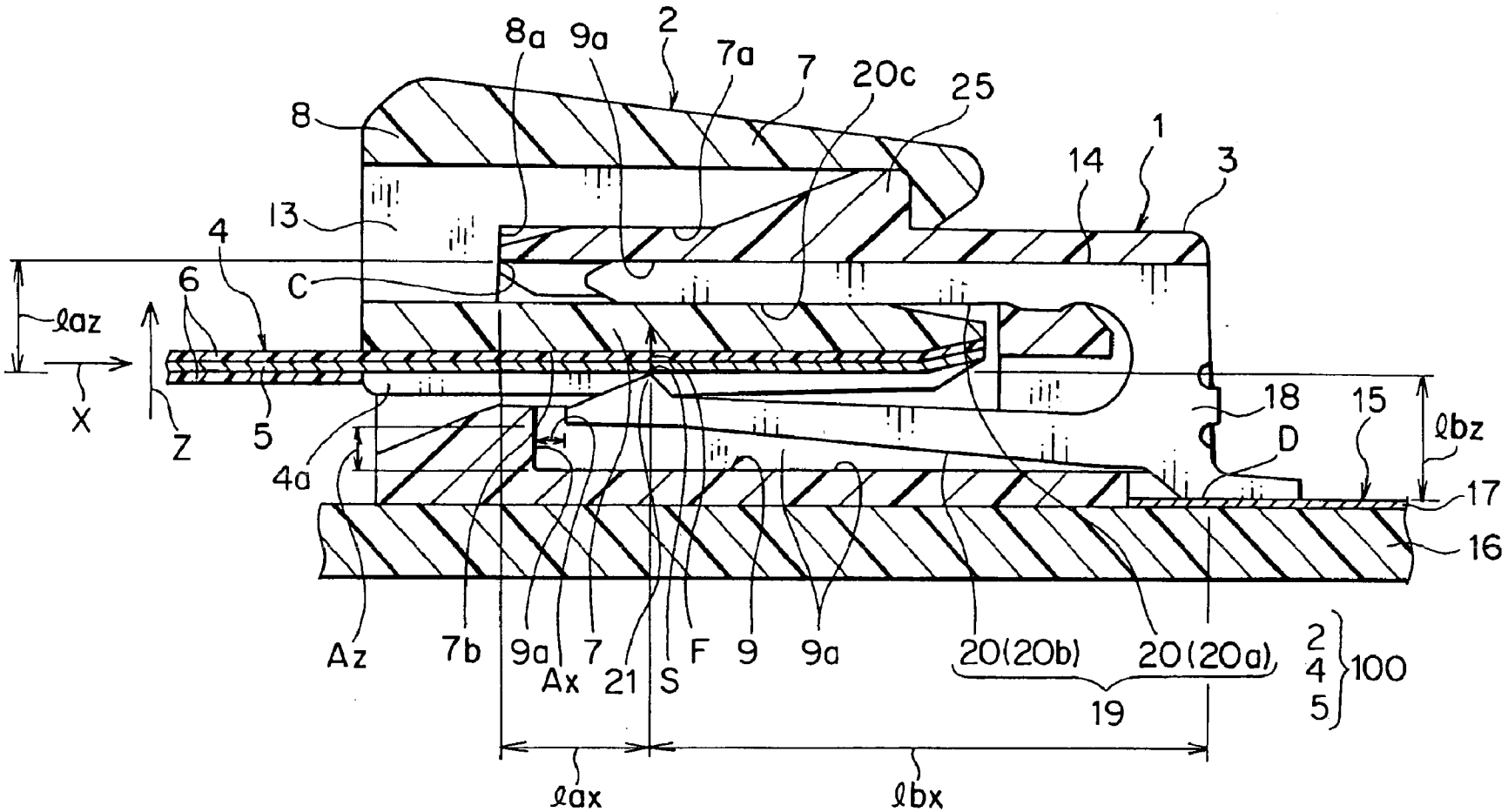
FIG. 8 is a sectional view taken in line VIII—VIII in FIG. 2.
Figure 9:
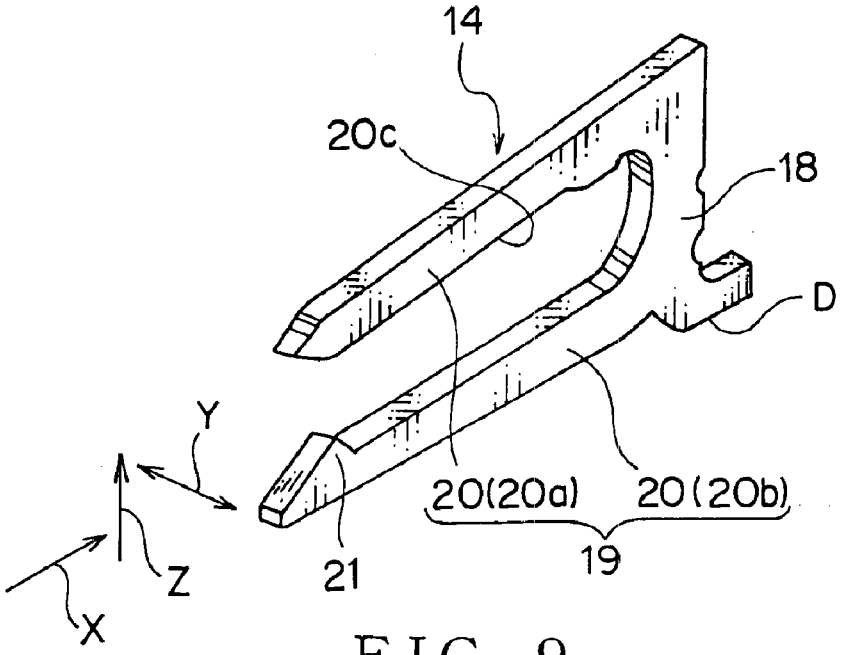
FIG. 9 is a perspective view of a terminal metal fitting according to this invention.
Figure 10:
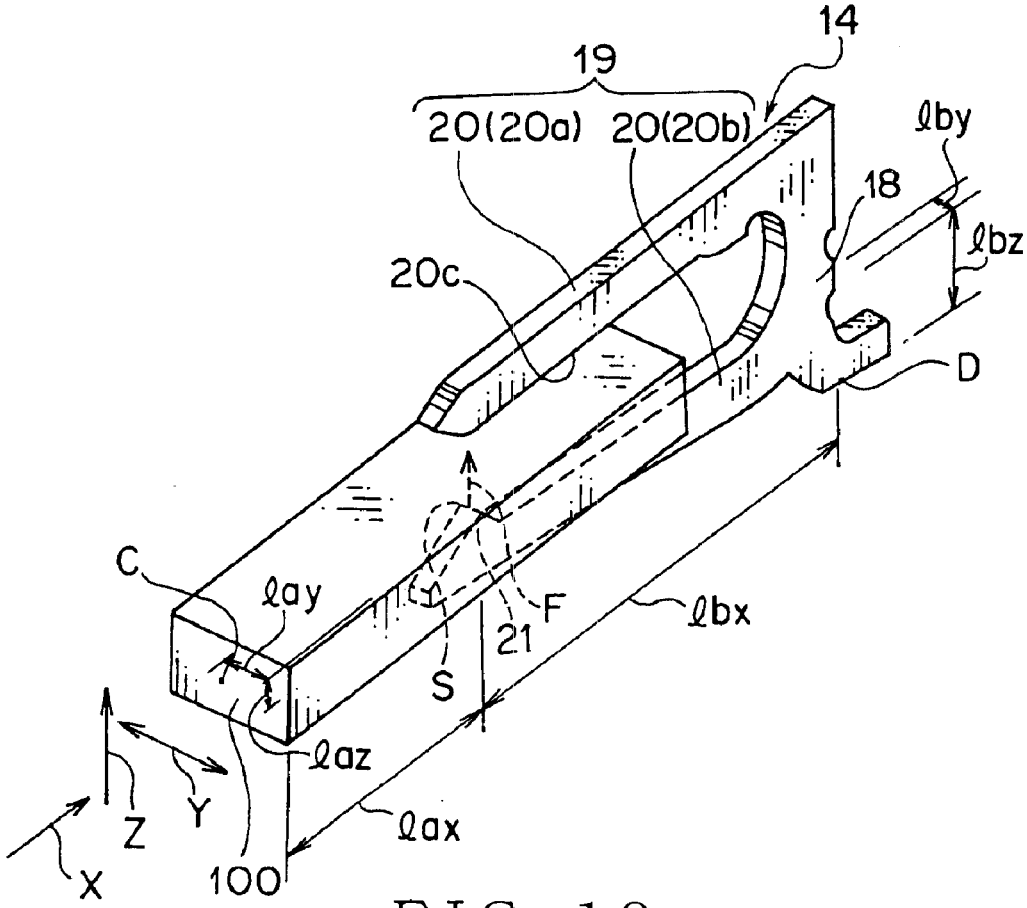
FIG. 10 is a schematic perspective view of the state where a complementary member is sandwiched between a pair of contact pieces of the terminal metal fitting according to this invention.
Figure 11A:
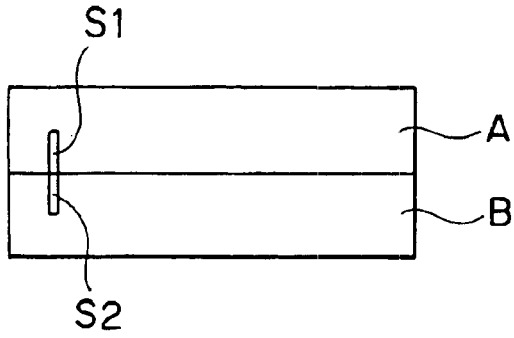
FIG. 11A is a view showing the state before the temperature which acts on the terminal metal fitting shown in FIG. 10 and the complementary member changes.
Figure 11B:
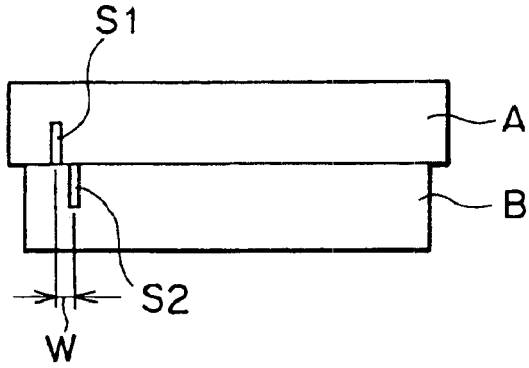
FIG. 11B is a view showing the state after the temperature which acts on the terminal metal fitting shown in FIG. 10 and the complementary member has changed.
Figure 14:
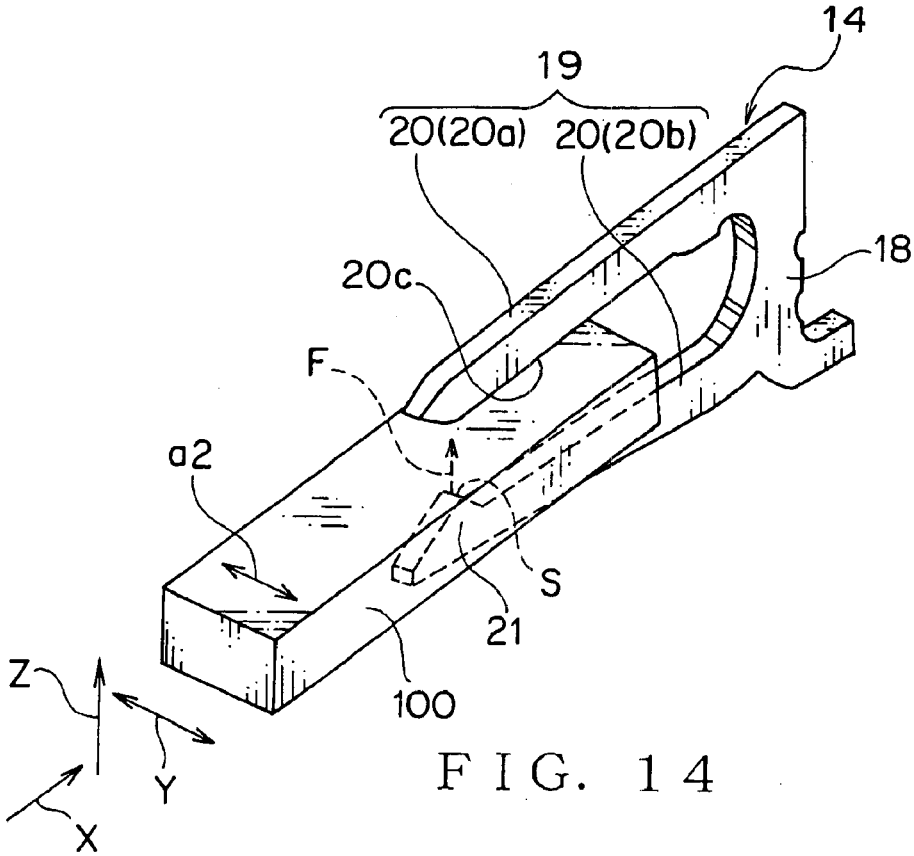
FIG. 14 is a side view of the state where another acceleration acts on the complementary member sandwiched between the contact pieces of the terminal metal fitting.
Figure 12:
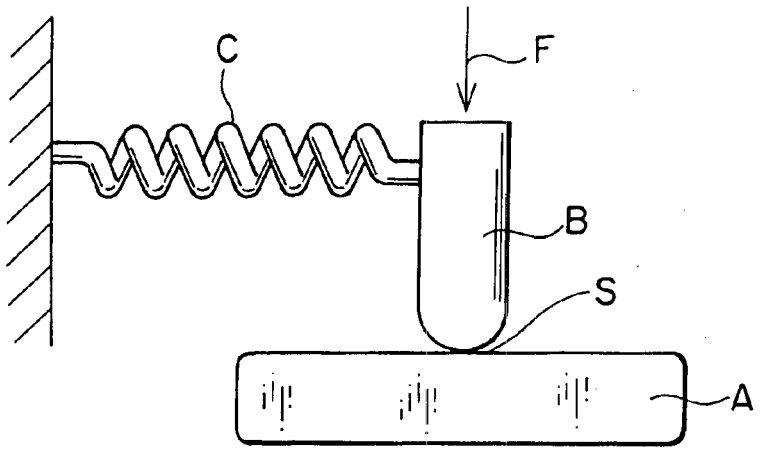
FIG. 12 is a view showing the state where the terminal metal fitting shown in FIG. 10 is elastically deformed.
Figure 13:
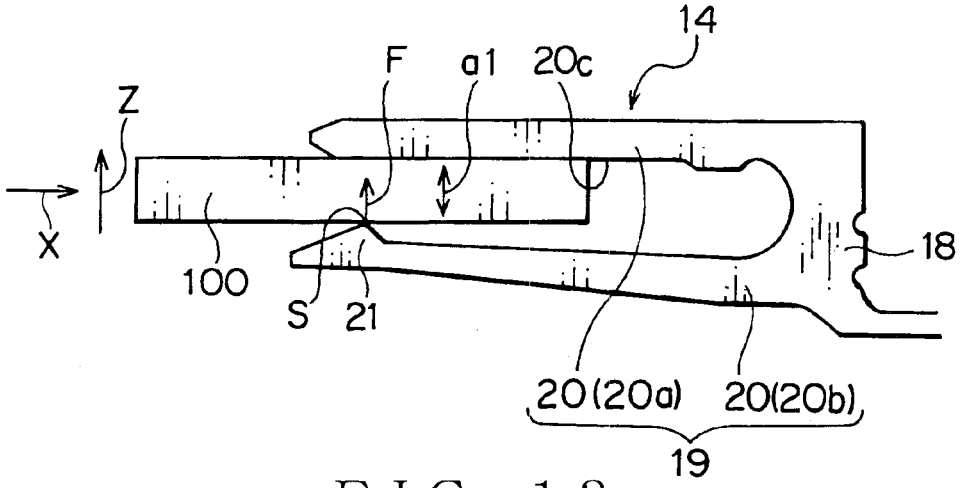
FIG. 13 is a side view of the state where an acceleration acts on the complementary member sandwiched between the contact pieces of the terminal metal fitting.

The pair of insulating sheets 6 are made of insulating synthetic resin and formed in a shape of belt. The pair of insulating sheets 6 sandwich the plurality of conductors therebetween so as to coat them. At the end of the end 4*a* of the FPC 4, as shown in FIGS. 7 and 8, one of the pair of insulating sheets 6 is removed so that the conductor 5 is exposed. The FPC 4 is assembled in a wire harness. Where the FPC is arranged in a motor vehicle, as shown in FIG. 3, it is fixed to a body panel 31 of the motor vehicle by means of a wiring clip 30.

The holder 2 is made of insulating synthetic resin, and elastically deformable. The holder 2, as shown in FIG. 7, integrally includes a pair of walls 7 in parallel to each other and a coupling wall 8 coupling the one ends of these walls 7, and formed in a U shape when viewed from the side.

The pair of walls 7 are formed in a square shape in its plan. The pair of walls 7 are formed as plates. The pair of walls 7 are superposed apart from each other.

At the inner face 7*a* of one of the pair of walls 7 and coupling wall 8, a locking hole 13 is formed as a fitting/receiving portion. The inner face 7*a* is a face of the one wall 7 opposite to the other wall 7. As seen from FIG. 7, the locking hole 13 is formed so as to be concave from the inner face 7*a* of the one wall 7, and does not penetrate through the one wall 7. The locking hole 13 penetrates through the coupling wall. The locking hole 13 is formed at the center in a longitudinal direction of the walls 7 of the holder 2, i.e. widthwise direction of the FPC 4. In the locking hole 13, an engagement protrusion 25 of the female housing is fitted.

At the outer face 7*b*of the other wall 7, with the insulating sheets 6 superposed, the end 4*a* of the FPC 4 is formed. In this way, the holder 2 supports the end 4*a* of the FPC 4.

The holder 2 and the portion 4*b* of the FPC 4 which ranges from the position where it is fixed to a body panel 31 by a wiring clip 30 to the above end 4*a* (FIG. 3) constitute a complementary member 100 defined in claims. The portion of the conductor 5 supported by the holder 2 constitutes a complementary conductor defined in claims. The FPC 4 constitutes a complementary electric wire defined in claims, which is electrically connected to the conductors 5 which are the complementary conductor. The holder 2 constitutes a complementary insulator defined in claims, which supports the conductors 5 of the FPC 4 and is fit in the female housing 3. In this way, the complementary member 100 includes the conductors 5 of the FPC 4 which serve as the complementary conductor, holder 2 which serves as the complementary insulator and FPC 4 which serves as the complementary electric wire.

When the holder 2 is coupled with the female housing 3, the inner face 8*a* of the coupling wall 8 of the holder 2 is brought into contact with the female housing 3. Therefore, the holder 2, i.e. complementary member 100 is fixedly coupled with the female housing 3 at the inner face 8*a* of the coupling wall 8. Thus, when the female housing 3 and holder 2 are coupled with each other, on the inner face 8*a*, the portion (symbol C in FIG. 8, first fixing portion) where the holder 2 is fixed to the female housing 3 is formed.

Figure 6:
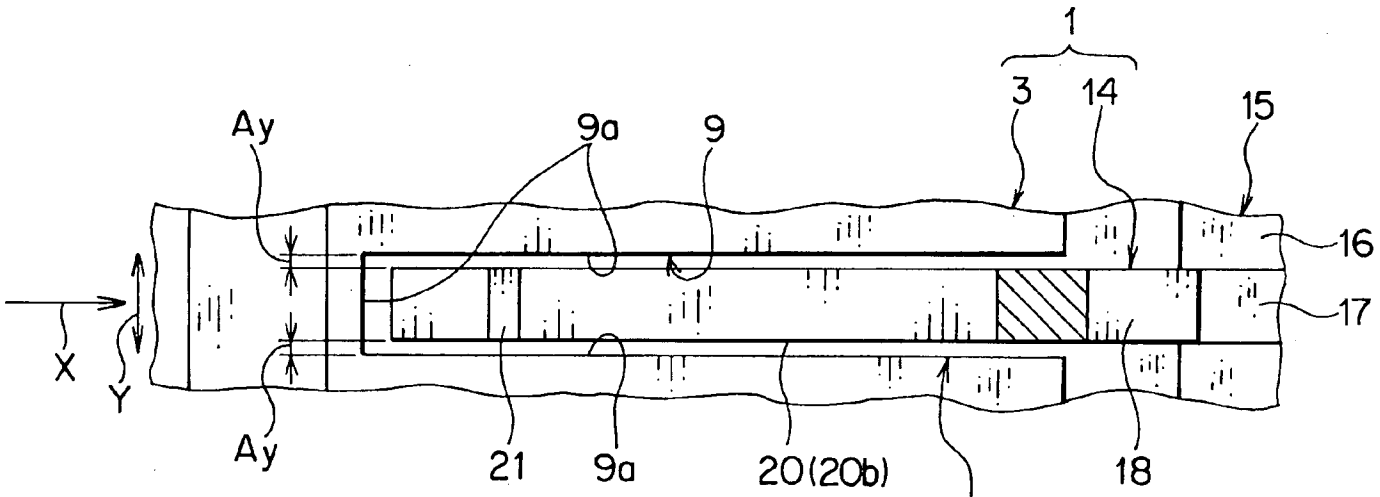
FIG. 6 is a sectional view taken in line VI—VI in FIG. 2.

The female housing 3 is made of synthetic resin. The female housing 3 is formed in a shape of a flat box. The female housing 3, as shown in FIGS. 5 and 8, includes a terminal chamber 9 where the terminal metal fitting 14 is housed and an engagement protrusion 25. A plurality of terminal chambers 9 are arranged to extend linearly as shown in FIG. 6 in a direction of arrow Y. The plurality of terminal chambers are in parallel to one another. The female housing 3 houses the plurality of terminal metal fittings 14 accommodated in the terminal chambers 9, respectively. Namely, the plurality of terminal metal fittings 14 are arranged in a direction of arrow Y. The terminal chamber 9 constitutes a cavity defined in claims. The engagement 25 protrudes from the outer face of the female housing 3.

The female housing 3, as shown in FIGS. 1 to 3, 5 and 8, is attached to a printed circuit board 15. The printed wiring board 15, as shown in FIGS. 1 to 3, 5 and 8, includes a base plate 16 of insulating synthetic resin and a conductor pattern 17 formed on the surface of the base plate 16. The conductor pattern 17 is made of a conductive metal such as copper, and formed as a thin film. The conductor pattern 17 is applied on the surface of the base plate 16.

The terminal metal fitting 14, as shown in FIGS. 5 and 6, is accommodated in the terminal chamber 9 of the female housing 3. When the female housing 3 is attached to the printed circuit board 15, the terminal metal fitting 14 is electrically connected to the conductor pattern 17. The plurality of terminal metal fittings 14 are housed in the female housing 3 so that they are arranged in a direction of arrow Y. As shown in FIGS. 5 and 8, the terminal metal fitting 14 includes a first electric contact portion 18 and a second electric contact portion 19 which are integral to each other. The terminal metal fitting 14 is made of a conductive metallic sheet.

The first electric contact portion 18 is formed in a shape of plate. The first electric contact portion 18 is fixed to the printed circuit board 15. When the terminal metal fitting 14 is housed in the female housing 3 and the female housing 3 is attached to the printed circuit board, the first electric contact portion 18 is electrically connected to the conductor pattern 17 of the printed circuit board 15. The portion (hereinafter referred to as a second fixing portion) where the first electric contact portion 18, i.e., terminal metal fitting 14 is fixed to the printed circuit board 15 is indicated by symbol D in FIG. 5 and others).

The second electric contact portion 19 includes a pair of contact pieces 20 in parallel to and apart from each other. The pair of contact pieces 20 are formed in a rod shape, and their one end communicates with the first electric contact portion 18. The contact pieces 20 extend in the same direction from the first electric contact portion 18. The holder 2 and conductor 5 of the FPC 4 with the end 4*a* supported by the holder 2 are inserted in between the pair of contact pieces 20 in a direction of arrow X in FIG. 5 which is the longitudinal direction of the contact pieces 20. The direction of arrow X is defined by the one direction in claims.

On the surface of the one contact piece 20 (hereinafter referred to as 20*a*), the conductor of the FPC supported by the holder 100 in the complementary member 100 is located, which is sandwiched between the one contact piece 20*a* and the other contact piece 20 (hereinafter referred to 20*b*). The other contact piece 20*b* is equipped with a contact projection 21 which is convex toward the one contact piece 20*a*. When the contact protrusion 21 is brought into contact with the conductor 5, the second electric contact portion 19, i.e. terminal metal fitting 14 is electrically connected to the FPC 4.

The other contact piece 20*b* is elastically deformable in a direction of the contact protrusion 21 approaching/leaving the one contact piece 20*a*. When the contact protrusion 21 is brought into contact with the FPC 4 supported by the holder 2 and sandwiched between the pair of contact pieces 20*a* and 20*b*, the other contact piece 20*b* generates the elastic restoring force F (FIG. 8) in a direction of arrow Z (FIG. 5) to urge the FPC 4 toward the one contact piece 20*a*. Namely, the direction of arrow Z is orthogonal to the direction of arrow X. The direction of arrow Z is defined as the second direction in claims. When the contact protrusion 21 is brought into contact with the conductor 5 of the FPC 4, at the tip of the contact protrusion 21, a contact S (FIG. 8) between the other contact piece 20*b* and the conductor 5 of the FPC 4, i.e. a contact between the terminal metal fitting 14 and the complementary member 100 is formed.

The one contact piece 20*a* is defined as a supporting portion in claims and the other contact piece 20*b* is defined as an elastic contact portion in claims.

When the female housing 3 and the holder 2 are coupled with each other, the second electric contact portion 19 is electrically connected to the conductor 5 of the FPC 4. The first electric contact portion 18 is electrically connected to the conductor pattern 17 on the printed circuit board. Thus, the terminal metal fitting 14 connects the conductor 5 of the FPC 4 and the conductor pattern 17 on the printed circuit board 15.

With the terminal metal fitting 14 accommodated in the terminal chamber 9 of the female housing 3 of the connector having the configuration described above, as shown in FIG. 2, the opening of the female housing 3 is faced with the edges of the walls 7 of the holder 2 on the side apart from the coupling portion 8. At this time, the terminal metal fitting 14 accommodated in the female housing 3 is fixed to the printed circuit board 15 at the second fixing portion D.

The other wall 7 of the holder 2 is inserted into the female housing 3. Thereafter, the engagement protrusion 25 of the female housing 3 is fit into the locking hole 13 of the holder 2 so that the connector 1 is coupled with the holder 2 as shown in FIGS. 1 and 8. The terminal metal fitting 14 sandwiches the holder 2 and the FPC 4 with the end 4*a* held thereby between the pair of contact pieces 20*a* and 20*b*. Further, the connector housing 3 is brought into contact with the inner face 8*a* of the coupling portion 8 of the holder 2 so that the first fixing portion C described above is formed.

As shown in FIGS. 5 and 6, with the terminal metal fitting 14 accommodated in the terminal chamber 9, the connector 1 provides a gap Ax, Ay, Az between the other contact piece 20*b* of the terminal metal fitting 14 and the inner face 9*a* of the terminal chamber 9. The gap Ax designates an interval between the other contact 20*b* of the terminal metal fitting 14 and the inner face 9*a* of the terminal chamber 9 in the direction of arrow X.

The gap Ay designates an interval between the other contact piece of the terminal metal fitting 14 and the inner face 9*a* of the terminal chamber 9 in the direction of arrow Y in FIG. 6 which is orthogonal to both the direction of arrow X and the elastic restoring force F. The direction of arrow Y is defined as the first direction in claims.

The gap Az designates an interval between the other end of the other contact piece 20*b* of the terminal metal fitting 14 and the inner face 9*a* of the terminal chamber 9 in the direction of arrow Z in FIG. 6.

The linear expansion coefficient of the union of the holder and conductor 5 of FPC 4 in the direction of arrow X is represented by βax. The distance between the first fixing portion C of the union of the holder and conductor of FPC and the above contact S in the direction of arrow X is represented by 1*ax*.

The linear expansion coefficient of the connector 1 which is the union of the female housing 3 and the terminal metal fitting 14 in the direction of arrow X is represented by βbx. The distance between the second fixing portion D of the connector 1 which is the union of the female housing 3 and terminal metal fitting 14 and the above contact S in the direction of arrow X is represented by 1*bx* (FIG. 8). The change in temperature which acts on the connector 1 and holder 2 is represented by ΔT. The gap Ax satisfies the following Equation 7

$$Ax \geqq \Delta T \times \beta ax \times 1ax - \Delta T \times \beta bx \times 1bx \quad (7)$$

Likewise, in the directions of arrows Y and Z, the linear expansion coefficients of the union of the holder and conductor of FPC are represented by βay and βaz, respectively. The distance between the fixing portion C S of the union of the holder and conductor of FPC and the above contact in the direction of arrow Z is represented by 1*az* (FIG. 8). The distance between the first fixing portion C in the same section as the one conductor 5 (referred to as 5*a*) of the plurality of conductors 5 of the FPC, and the contact S between each conductor 5 and terminal metal fitting 14 in the direction of arrow Y in the direction of arrow Y is represented by 1*ay* (FIG. 3).

In the directions of arrows Y and Z, the linear expansion coefficients of the connector 1 which is the union of the female housing 3 and terminal metal fitting 14 are represented by βby and βbz, respectively. The distance between the second fixing portion D of the connector 1 which is the union of the female housing 3 and terminal metal fitting 14 and the above contact S in the direction of arrow Z is represented by 1*bz* (FIG. 8). The distance between the second fixing portion D of the one (referred to as 14*a*) of the plurality of terminal metal fittings 14 and the contact S between each terminal metal fitting 14 and conductor 5 in the direction of arrow Y is represented by 1*bx* (FIG. 3). The one conductor 5*a* and the terminal metal fitting 14*a* which are employed as the standard to define the above distances 1*ay* and 1*by* are preferably in contact with each other, or electrically connected to each other.

$$Ay \geqq \Delta T \times \beta ay \times 1ay - \Delta T \times \beta by \times 1by \quad (8)$$

$$Az \geqq \Delta T \times \beta az \times 1az - \Delta T \times \beta bz \times 1bz \quad (9)$$

As understood from the above Equations (7) to (9) and Equation (1), the above Ax, Ay and Az are not smaller than the relative displacements between the terminal metal fitting 14 and the conductor 5 of FPC 4 assuming that the temperature change is ΔT. For this reason, when the temperature change is ΔT, the terminal metal fitting 14 and female housing 3, and the holder 2 and the conductor 5 of the FPC 4 of the complementary member 100 are permitted to expand or contract.

Thus, the gap Ax in the direction of arrow X, gap Ay in the direction of arrow Y and gap in the direction of arrow Z satisfy the above Equation (1). The gap Ax corresponds to the gap A in a direction in claims. The gap Ay corresponds to the gap A in the first direction in claims. The gap Az corresponds to the second direction in claims.

Assuming that the static friction coefficient between the conductor 5 of FPC 4 and the contact protrusion 21 is represented by $\mu$, the respective elastic coefficients kx, ky and kz in the directions of arrow X, arrow Y and arrow Z satisfy the relationships represented by the following Equations (10), (11) and (12).

$$\Delta T\times\beta ax\times 1ax-\Delta T\times\beta bx\times 1bx\leqq 2\times(\mu\times F/kx) \quad (10)$$

$$\Delta T\times\beta ay\times 1ay-\Delta T\times\beta by\times 1by\leqq 2\times(\mu\times F/ky) \quad (11)$$

$$\Delta T\times\beta az\times 1az-\Delta T\times\beta bz\times 1by\leqq 2\times(\mu\times F/kx) \quad (12)$$

As understood from Equations (10) to (12), assuming that the temperature change is ΔT, when the terminal metal fitting 14 and the FPC 4 expand or contract, the contact protrusion 21 and conductor 5 are not shifted relatively from each other. While the terminal metal fitting 14 and FPC 4 expand or contract, when the contact S is displaced, the other contact piece 20*b* of the terminal metal fitting 14 is elastically deformed with. the displacement of the contact S.

The terminal metal fitting 14 and the conductor 5 of the FPC 4 are not shifted relatively from each other at the contact S. Therefore, when the temperature change is ΔT, the contact S between the contact 21 of the terminal metal fitting 14 and the conductor 5 of the FPC 4 is prevented from being displaced. Further, the elastic coefficients kx, ky and kz are proportional to the elastic restoring force F. Therefore, by suppressing the elastic coefficients kx, ky and kz or rigidity of the other contact piece 20*b* of the terminal metal fitting 14, the contact protrusion 21 and conductor 5 are not relatively shifted from each other so that the elastic restoring force F or contact load between the contact protrusion 21 and the conductor 5 can be suppressed.

The elastic coefficients kx, ky and kz of the other contact piece 20*b* in the directions of arrow X, arrow Y and arrow Z satisfy Equation 4, respectively. The elastic coefficient ky corresponds to the elastic coefficient k of contact piece 20*b* in a direction in claims; elastic coefficient ky corresponds to the elastic coefficient k of contact piece 20*b* in the first direction in claims, elastic coefficient kz corresponds to the elastic coefficient k of contact piece 20*b* in the second direction in claims.

For the acceleration a1 in the direction of arrow Y, i.e., along the elastic restoring force F which acts on the complementary member 100 consisting of the portion 4*b* of FPC 4 and holder 2, assuming that the mass of the complementary member 100 is m, the elastic restoring force F satisfies the relationship represented by Equation (5). Therefore, even when the acceleration a1 acts on the complementary member 100 consisting of the portion 4*b* of FPC 4 and holder 2, the holder 2 and FPC 4 remains sandwiched and immobile between the pair of contact pieces 20*a* and 20*b* of the terminal metal fitting 14. Thus, the contact protrusion 21 of the terminal metal fitting 14 and the conductor 5 of FPC 4 are not displaced.

For the acceleration a2 in the direction which is orthogonal to that of arrow Z, i.e., in the direction orthogonal to the elastic restoring force F which acts on the complementary member 100 consisting of the portion 4*b* of FPC 4 and holder 2, assuming that the mass of the complementary member 100 is m, the elastic restoring force F satisfies the relationship represented by Equation (6). Therefore, even when the acceleration a2 acts on the complementary member 100 consisting of the portion 4*b* of FPC 4 and holder 2, the holder 2 and FPC 4 remains sandwiched and immobile between the pair of contact pieces 20*a* and 20*b* of the terminal metal fitting 14. Thus, the contact protrusion 21 of the terminal metal fitting 14 and the conductor 5 of FPC 4 are not shifted relatively from each other.

In accordance with this embodiment, the elastic coefficients kx, ky and kz of the terminal metal fitting 14 of the connector 1 in the directions of arrow X, arrow Y and arrow Z satisfy Equations (10) to (12). For this reason, even when the temperature changes by ΔT, the contact protrusion 21 of the other contact piece 20*b* of the terminal metal fitting 14 and the conductor 5 of FPC 4 are not shifted relatively at the contact S. The contact S between the contact protrusion 21 of the other contact piece 20*b* and the conductor 5 of the FPC 4 is not displaced, but the other contact piece 20*b* is deformed with the displacement of the contact S. Where the connector is employed in the wire harness arranged in a vehicle, even when the ambient temperature changes by ΔT, the other contact piece 20*b* and conductor of FPC are not shifted relatively from each other at the contact S, the other contact piece 20*b* and conductor of FPC can be kept in contact with each other at the contact S, thereby preventing fretting corrosion.

Therefore, by suppressing (reducing) the rigidity of the terminal metal fitting 14 so as to satisfy Equation (4), the elastic restoring force F of the other contact piece 20*b*, i.e., contact load between the contact protrusion 21 of the other contact piece 20*b* of the terminal metal fitting 14 and and conductor of FPC can be suppressed (reduced). Therefore, when the downsizing of the terminal metal fitting 14 and its multi-poles and low insertion force of the connector are realized, the contact protrusion 21 of the other contact piece 20*b* and the conductor 5 are not shifted relatively from each other at the contact S (fretting corrosion does not occur).

The gaps Ax, Ay and Az between the terminal metal fitting 14 and the inner face 9*a* of the terminal chamber 9 in the directions of arrow X, arrow Y and arrow Z satisfy Equations (7) to (9) and so is not smaller than the distance W represented by Equation (1). Therefore, the elastic deformation of other contact piece 20*b* of the terminal metal fitting 14 is not obstructed by the inner face 9*a* of the terminal chamber 9. Thus, the other contact piece 20*b* can be elastically deformed surely. The contact protrusion 21 of the other contact piece 20*b* and the conductor 5 of FPC 4 are not shifted relatively from each other at the contact S. The displacement of the contact S can be prevented surely, thereby preventing the fretting corrosion from occurring.

The elastic restoring force F generated by the other contact piece 20*b* satisfy Equations (5) and (6). Therefore, even when the acceleration a1 in the direction of arrow Z and the acceleration a2 in the direction arrow orthogonal thereto act on the FPC 4 and holder 2, the holder 2 and FPC 4 are not shifted between the pair of contact pieces 20*a* and 20*b* and remain sandwiched therebetween. Thus, even when the accelerations a1 and a2 act on the FPC 4 and holder 2, the contact piece 21 of the other contact piece 20*b* of the terminal metal fitting 14 and the conductor 5 of the FPC 4 are not shifted relatively from each other so that the contact S is not displaced.

Thus, where the connector is employed in the wire harness arranged in a motor vehicle, even when the accelerations a1 and a2 act, the contact protrusion 21 of the other contact piece 20*b* and conductor 5 of FPC 4 are not shifted relatively from each other so that they are kept in contact with each other at the contact S. Accordingly, the other contact piece 20*b* of the terminal metal fitting 14 can surely prevent the displacement of the contact S, thereby preventing occurrence of the fretting corrosion.

In the above embodiment, the inner face 8*a* of the coupling wall 8 of the holder 2 is in contact with the female housing 3 so that the first fixing portion C is formed on the inner face 8*a*. However, in this invention, it is of course that the first fixing portion C may be located at various positions. Further, the first electric contact portion 18 is secured to the printed wiring board 15 to provide the second fixing portion D where the terminal metal fitting 14 is fixed. However, in this invention, by directly fixing the terminal metal fitting 14 to the female housing, the second fixing portion D may be located at various positions.

In the embodiment described above, the explanation has been given of the terminal metal fitting 14 and connector 1 in which the FPC is sandwiched between the pair of contact pieces 20*a* and 20*b*. However, as shown in FIGS. 15 to 19, this invention may be applied to the connector 53 which includes a female terminal metal fitting (referred to as a female terminal) 41 to be connected to a male terminal fitting (referred to as a male terminal) 40 and a male connector housing (male housing) 52 which houses the female terminal 41. The male housing 52 is defined as a connector housing in claims. The female terminal 41 is defined as a terminal metal fitting in claims. In FIGS. 15 to 19, like reference numerals refer to like elements in the embodiment described above.

The male terminal 40 is made of a conductive metal plate and includes an electric wire connecting portion 42 and an electric contact portion 43. An electric wire 44 is secured to the wire connecting portion 42. The wire connecting portion 42 is electrically connected to the electric wire 44. The electric connecting portion 43 is communicated with the electric wire connecting portion 42 and is provided with a tab 45 formed in a shape of rod or plate. The male terminal 40 with the wire secured there to is housed in a female connector housing (female housing) 54 (FIGS. 18 and 19) made of insulating synthetic resin. The tab 45 is defined as a complementary conductor in claims. The electric wire 44 is defined as a complementary electric wire electrically connected to the tab 45 in claims.

Figure 18:
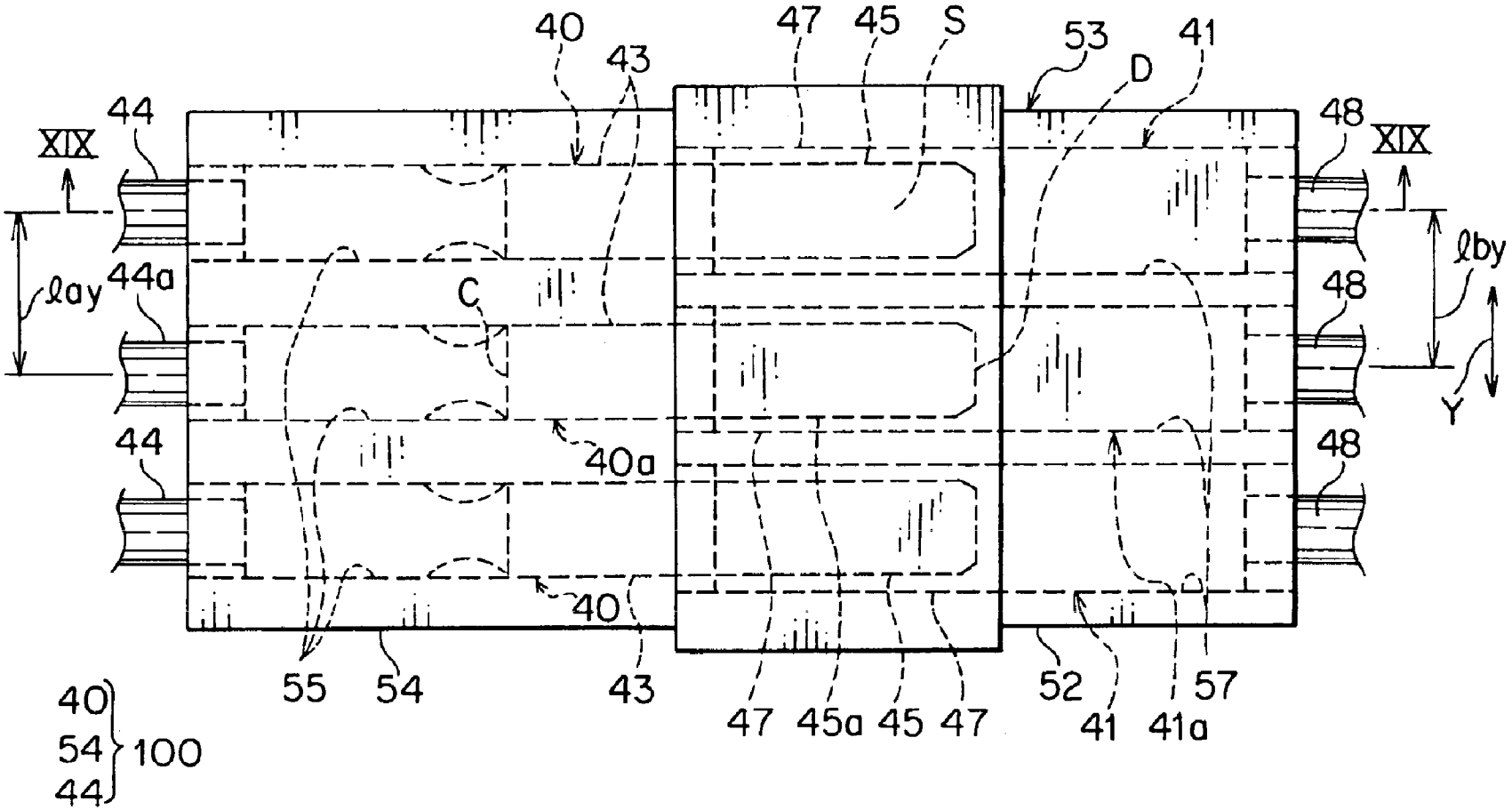
FIG. 18 is a plan view of the state where the female terminal shown in FIG. 15 is housed in a male housing and a tab of the electric contact of a male terminal is inserted in a cylinder.
Figure 19:
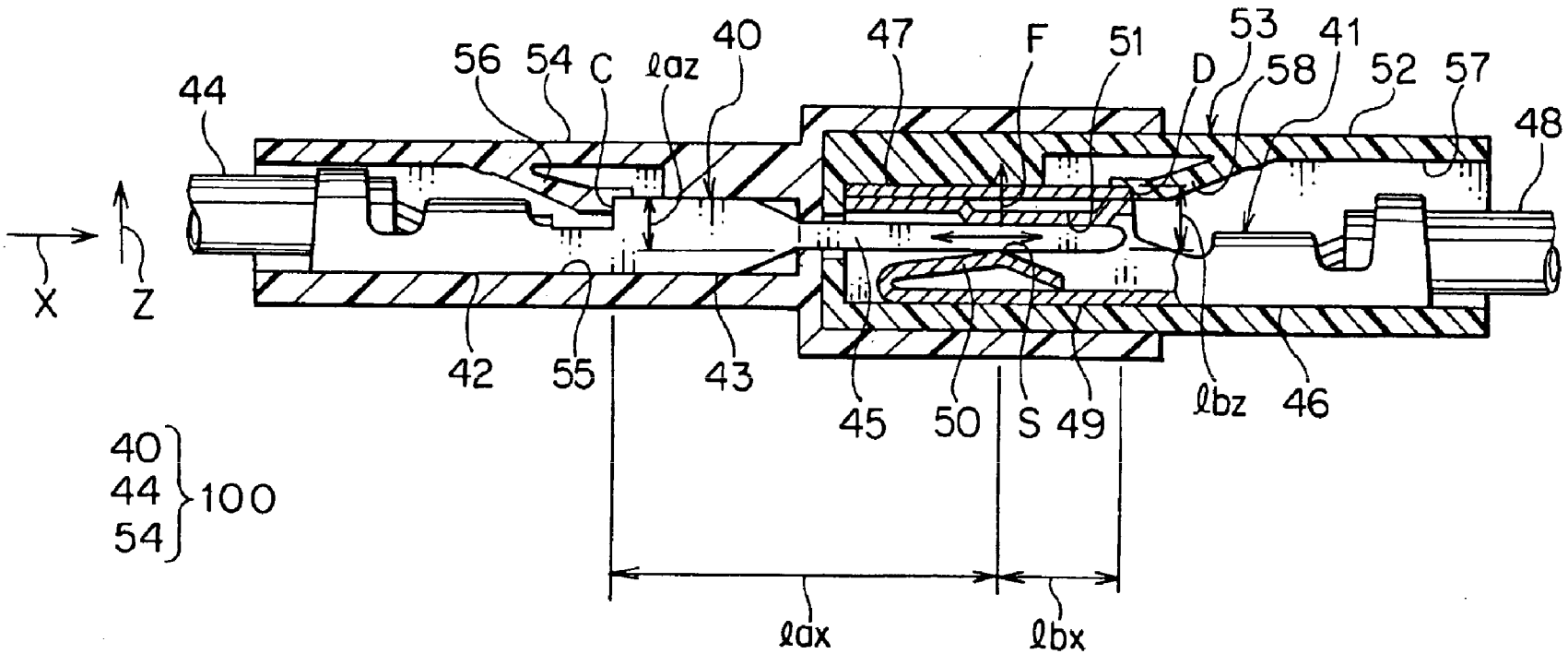
FIG. 19 is a sectional view taken in line XIX—XIX in FIG. 18

The female housing 54 shown in FIGS. 18 and 19 is made of insulating synthetic resin and formed in a shape of box. The female housing 54 is provided with a plurality of terminal chambers 55 each for accommodating the male terminal 40. In each of the terminal chambers 55 of the female housing 54, a securing lance 56 to be secured to the male terminal 40 is provided. The securing lance 56 is secured to the male terminal 40 so that the male terminal 40 is fixed to the female housing 54. The portion where the securing lance 56 is secured to the male terminal 40 is defined as the first fixing portion C in claims. The female housing 54 is insulating and supports the tab 45 of the male terminal 40, and is defined as a complementary insulator.

The female terminal 41 is made of a conductive metallic plate, and is provided with an electric wire connecting portion 46 and an electric contact portion 47. An electric wire 48 is secured to the electric wire connecting portion 46. The electric wire connecting portion 46 is connected to the electric wire 48. The electric contact portion 47 includes a cylindrical portion 49 communicating with the electric connecting portion 46 and an elastic contact piece 50 serving as an elastic contact portion.

Figure 17:
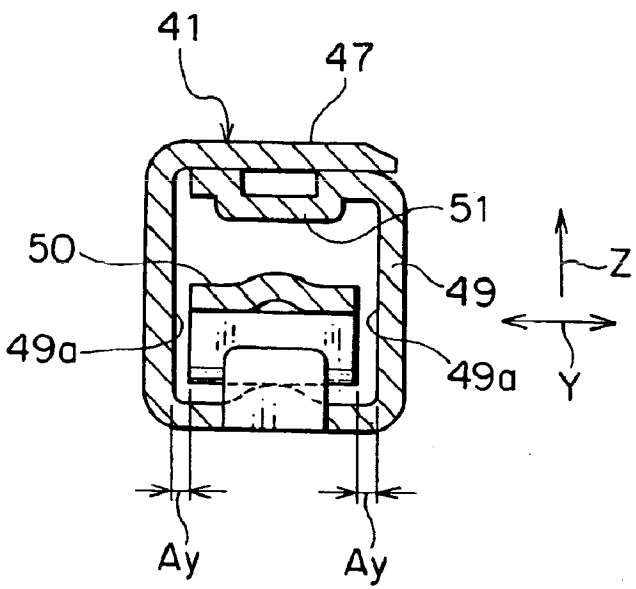
FIG. 17 is a section view taken in line XVII—XVII in FIG. 16.
Figure 16:
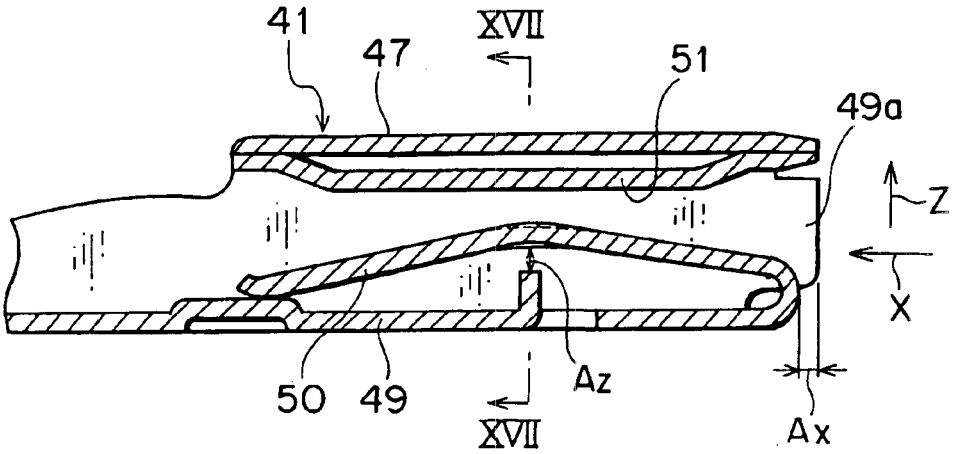
FIG. 16 is a sectional view taken in line XVI—XVI in FIG. 15.
Figure 15:
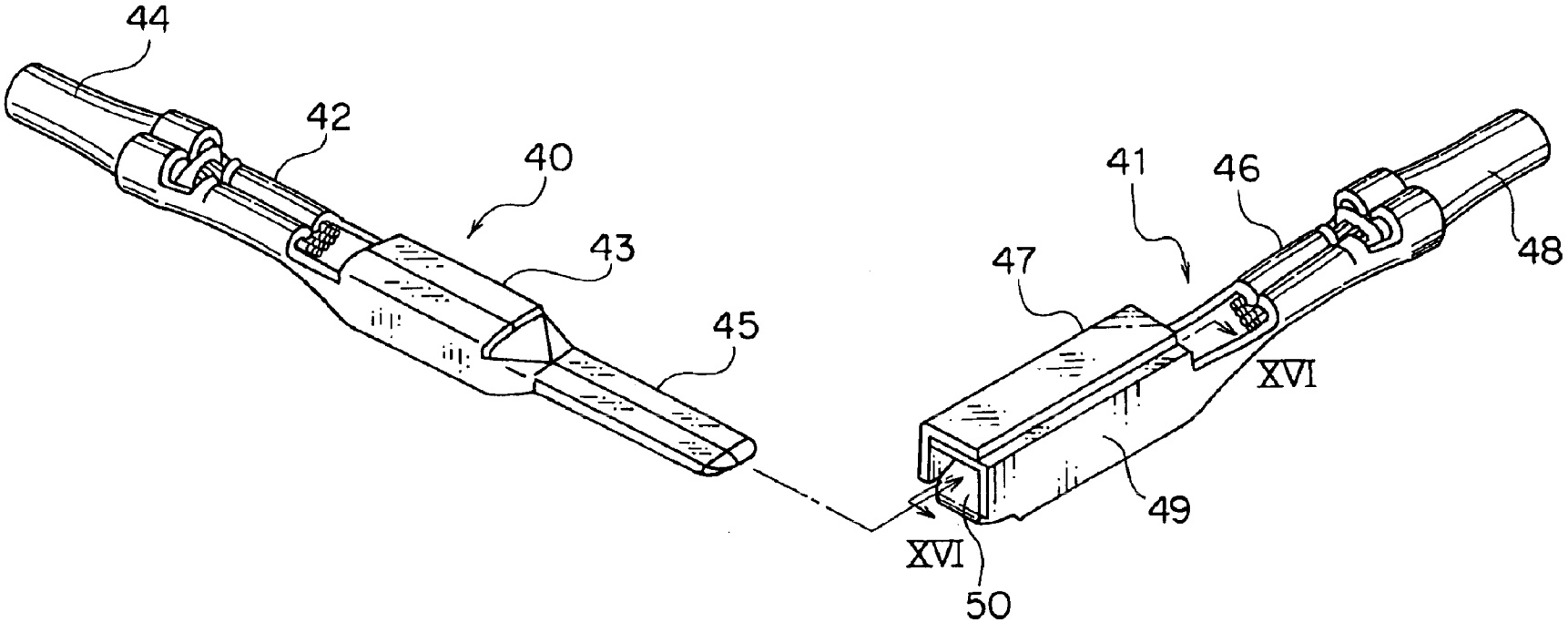
FIG. 15 is a perspective view of a female terminal and other elements in a modification of this invention.

As seen from FIGS. 16 to 18, the cylindrical portion 49 is formed in a shape of cylinder. The cylindrical portion 49 is defined as a cavity in claims. Into the cylindrical portion 49, the tab 45 of the electric contact portion 43 of the male terminal 40 is to be inserted. The elastic contact piece 50 is accommodated in the cylindrical portion 49. The elastic contact piece 50 is oppositely to and apart from the one wall face 51 of the cylindrical portion 49. The one wall face 51 is defined as a supporting portion in claims. The elastic contact piece 50, when the tab 45 of the electric contact 43 of the male terminal 40 is inserted into the cylindrical portion 49, generates the elastic restoring force F which urges the tab 48 toward the one wall face 51 as shown in FIG. 18.

The female terminal 41 with the electric wire 48 secured thereto is housed in the male housing 52 made of insulating synthetic resin.

The male housing 52 shown in FIGS. 18 and 19 is made of insulating synthetic resin and formed in a shape of box. The male housing 52 includes a plurality of terminal chambers 57 each accommodating the female terminal 41. In each of the terminal chambers 57 of the male housing 52, a securing lance 58 which is secured to the female terminal 41 is provided. The securing lance 58 is secured to the male terminal 40 so that the female terminal 41 is fixed to the male housing 52. In claims, the portion where the securing lance 58 is secured to the female terminal 41 is defined as the second fixing portion D where the female terminal 41, i.e. the elastic contact piece 50 is fixed.

The female terminal 41 and male housing 52 constitute a connector 53 defined in claims. As shown in FIGS. 18 and 19, the male housing 52 housing the female terminal 41 is coupled with the female housing 54 which houses the male terminal 40 so that the tab 45 of the electric contact portion 43 of the male is inserted into the cylindrical portion 49 of the female terminal 41 in a direction of arrow X in parallel to the longitudinal direction of the elastic contact piece 50 shown in FIG. 16. The tab 45 of the electric contact portion 43 is urged by the elastic contact piece 50 with the elastic restoring force F toward the one wall face 51 in a direction of arrow Z in FIG. 19. Thus, the contact S between the elastic contact piece 50 and the tab 45 is formed. Further, the male terminal 40 and the female terminal 41 are electrically connected to each other. Namely, the electric wires 44 and 48 are electrically connected to each other. Incidentally, the male terminal 40, female housing 54 and electric wire 44 attached to the male terminal 40 constitute a complementary member 100 defined in claims.

The linear expansion coefficient of the union consisting of the male terminal 40 and the male housing 52 in the direction of arrow X is represented by βax. The distance between the contact S and the first fixing portion C of the union consisting of the male terminal 40 and the connector housing 52 in the direction of arrow X is represented by 1*ax* (FIG. 19).

The linear expansion coefficient of the connector 53 consisting of the male housing 52 and the female terminal 41 is represented by βbx. The distance between the second fixing portion D and contact S of the connector 53 consisting of the male housing 52 and female terminal 41 in the direction of arrow X is represented by 1*bx* (FIG. 19).

The linear expansion coefficients of the union consisting of the male terminal 40 and connector housing 52 in the directions of arrows Y and Z are represented by βax βaz. The distance between the contact S and the first fixing portion C of the union consisting of the male terminal 40 and connector 52 in the direction of arrow Z is represented by 1*az* (FIG. 19). The distance in the direction of arrow 1*ay* (FIG. 18) between the first fixing portion C (FIG. 18) which is located in the same section as the one (indicated by symbol 44*a*) of the plurality of electric wires 44, and the contact S between each tab 45 and the elastic contact piece 50 is represented by 1*ay* (FIG. 18).

The linear expansion coefficients of the connector 53 consisting of the male housing 52 and the female terminal 41 in the directions of arrows Y and Z are represented by βby and βbz. The distance between the contact S and the second fixing portion D of the connector 53 consisting of the male housing 52 and female terminal 41 in the direction of arrow Z is represented by 1*bz* (FIG. 19). The distance in the direction of arrow of Y (FIG. 18) between the second fixing portion D (FIG. 18) of the one (indicated by 41*a*) of the plurality of female terminals 41 and the contact S between each female terminal 41 and tab 45 is represented by 1*by* (FIG. 18). The one electric wire 44*a* and one female terminal 41*a* which are standards for determining the distances 1*ay* and 1*by* are preferably electrically connected to each other.

With respect to the female terminal 41 also, as seen from FIGS. 16 and 17, the gaps Ax, Ay and Az between the elastic contact piece 50 and the inner face 4*a* of the cylindrical portion 49 in the directions of arrows X, Y, and Z satisfy Equations (7) to (9) and greater than the displacement W represented by Equation (1).

The respective elastic coefficients kx, ky and kz of the elastic contact piece 50 of the female terminal 41 in the directions of arrows X, Y and Z satisfy Equations (10) to (12). In the female terminal 41 also, assuming that the mass of the complementary member 100 is m, the elastic restoring force F of the elastic contact piece 50 satisfy Equations (5) and (6).

In the female terminal 41 also, the elastic contact piece 50 is elastically deformed with a change in the temperature by ΔT. Where the connector is employed in the wire harness arranged in a motor vehicle, even when the ambient temperature changes by ΔT, the elastic contact piece 50 and the tab 45 of the electric contact portion 43 are not shifted relatively from each other at the contact S and the contact S is immobile, thereby preventing fretting corrosion.

Thus, by suppressing (or reducing)the respective elastic coefficients kx, ky and kz, i.e. rigidity of the elastic contact piece 50, the elastic restoring force of the elastic contact portion 50, the elastic restoring force F of the elastic contact portion 50, i.e. the contact load between the terminals 40 and 41 can be suppressed (reduced). Therefore, when the downsizing of the female terminal 41 and its multi-poles and low insertion force of the connector 53 are realized, the female terminal 41 can be surely electrically connected to the tab 45 of the male terminal 40 with no fretting corrosion.

The gaps Ax, Ay and Az between the elastic contact piece 50 and the inner face 49*a* of the cylindrical portion 49 satisfy Equations (7) to (9) and are not smaller than the displacement W represented by Equation (1). Therefore, the elastic deformation of the elastic contact piece 50 is not obstructed by the inner face 49*a* of the cylindrical portion 49. Thus, the elastic contact piece 50 can be surely elastically deformed so that the displacement of the contact S can be prevented, thereby preventing the fretting corrosion.

The elastic restoring force F generated by the elastic contact piece 50 satisfy Equations (5) and (6). Therefore, even when the acceleration a1 in the direction of arrow Z and the acceleration a2 in the direction orthogonal to the direction of arrow Z act on the male terminal 40, the male terminal 40 and others do not move between the elastic contact piece 50 and the one wall face 51 so that the tab 45 of the male terminal 40 remains sandwiched therebetween. Thus, the contact S between the terminals 40 and 41 is not displaced. Further, where the connector is employed in the wire harness arranged in a motor vehicle, even when the accelerations a1 and a2 act on the male terminal 40, the tab 45 and the elastic contact piece 50 can be kept in contact with each other at the contact S. For this reason, the elastic contact piece 50 of the female terminal 41 can prevent the displacement of the contact S between itself and tab 45, thereby preventing the fretting corrosion.

In the embodiments described above, the FPC 4 or electric wires 44 and 48 were used as the electric wires. However, in place of them, a flexible flat cable (FFC) may be adopted.

The distances 1*ax*, 1*ay* and 1*az* in the embodiments described above may be changed according to the fixing position and fixing direction of the conductors 5 of FPC 4 and tab 45 of the male terminal 40. In short, the above distances 1*ax*, 1*ay* and 1*az* may be those between the portion C where the conductor 5 of FPC or the tab 45 of the male terminal 40 is fixed and the contact S between the complementary conductor, and the contact piece 20*b* of the terminal metal fitting 14 or the elastic contact piece 50 of the female terminal 41.

The distances 1*bx*, 1*by* and 1*bz* in the embodiments described above may be changed according to the fixing position and fixing system of the terminal metal fitting 14 and the female terminal 41. In. short, the above distances 1*ax*, 1*ay* and 1*az* may be those between the portion D where the terminal metal fitting 14 or female terminal 41 is secured to the connector housing or printed wiring board and the contact S between the complementary conductor and the contact piece 20*b* of the terminal metal fitting 14 or the elastic contact piece 50 of the female terminal 41.

What is claimed is:

1. A connector comprising:

a terminal metal fitting including a supporting portion and an elastic contact portion located apart therefrom within a cavity, a complementary conductor being located on the surface of said supporting portion, the complementary conductor being sandwiched between said supporting portion and said elastic contact portion under an elastic restoring force urging said complementary conductor toward said supporting portion; and a connector housing which houses said terminal metal fitting and is coupled with a complementary insulator supporting said complementary conductor, wherein a gap is formed between said elastic contact portion and inner face of said cavity, and assuming that the gap is A, a temperature change acting on said complementary conductor and insulator and said elastic contact portion is ΔT, a linear expansion coefficient of a union consisting of said complementary conductor and complementary insulator is βa, a distance between a first fixing portion where said complementary conductor is fixed and a contact between said complementary conductor and said elastic contact portion is 1*a*, a linear expansion coefficient of a union consisting of said connector housing and said terminal metal fitting is βb, and a distance between a second fixing portion where the said terminal metal fitting is fixed and said contact is 1*b*, $$A \geqq = \Delta T \times \beta a \times 1a - \Delta T \times \beta b \times 1b,$$

and assuming that the elastic coefficient of said elastic contact is k, the static friction between said complementary conductor and said elastic contact portion is $\mu$ and the elastic restoring force of said elastic contact portion is F, $$\Delta T \times \beta a \times 1a - \Delta T \times \beta b \times 1b \leqq 2 \times (\mu \times F/k).$$

2. A connector according to claim 1, wherein said conductor is inserted between said supporting member and said contact portion in a one direction and sandwiched therebetween, and said gap A in a first direction orthogonal to both said one direction and said elastic restoring force and in a second direction orthogonal to said one direction and along said elastic restoring force is expressed by $$A \geqq = \Delta T \times \beta a \times 1a - \Delta T \times \beta b \times 1b, \text{ and}$$

said elastic coefficient k in the respective one direction, said first direction and said second direction is expressed by $$\Delta T \times \beta a \times 1a - \Delta T \times \beta b \times 1b \leqq 2 \times (\mu \times F/k).$$

3. A connector according to claim 2, wherein said complementary conductor, said complementary insulator and said electric wire connected to said complementary conductor constitute a complementary member, and assuming that the acceleration which acts on said complementary member along said second direction is a1 and the mass of said complementary member is m, the elastic restoring force F of said elastic contact portion is expressed by $$F > m \times a1.$$

4. A connector according to claim 2, wherein said said complementary conductor, said complementary insulator and said electric wire connected to said complementary conductor constitute a complementary member, and assuming that the acceleration which acts on said complementary member along a direction orthogonal to said second direction is a2 and the mass of said complementary member is m, the elastic restoring force F of said elastic contact portion is expressed by $$F > m \times a2/\mu.$$

5. A connector according to claim 3, wherein said said complementary conductor, said complementary insulator and said electric wire connected to said complementary conductor constitute a complementary member, and assuming that the acceleration which acts on said complementary member along a direction orthogonal to said second direction is a2 and the mass of said complementary member is m, the elastic restoring force F of said elastic contact portion is expressed by $$F > m \times a2/\mu.$$

* * * * *